US005861227A

United States Patent [19]

Ikeda et al.

[11] Patent Number: 5,861,227

[45] **Date of Patent: *Jan. 19, 1999**

[54] METHODS AND MANUFACTURING ELECTRON-EMITTING DEVICE, ELECTRON SOURCE, AND IMAGE-FORMING APPARATUS

[75] Inventors: Sotomitsu Ikeda, Atsugi-shi; Masato Yamanobe, Machida-shi; Ichiro Nomura, Atsugi-shi; Hidetoshi Suzuki, Fujisawa-shi; Yoshikazu Banno, Machida; Takeo Tsukamoto, Atsugi-shi; Shinichi Kawate, Sagamihara-shi; Toshihiko Takeda, Yamato-shi; Keisuke Yamamoto, Yamato-shi; Kazuhiro Sando, Atsugi-shi; Yasuhiro Hamamoto, Machida, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 533,987

[22] Filed: Sep. 27, 1995

[30] Foreign Application Priority Data

| | | | |
|---|---|---|---|
| Sep. 29, 1994 | [JP] | Japan | 6-259075 |
| Dec. 1, 1994 | [JP] | Japan | 6-321157 |

[51] Int. Cl.[6] ..... H01J 1/02; G03G 15/32

[52] U.S. Cl. ..... 430/31; 427/49; 313/309

[58] Field of Search ..... 430/31, 296; 427/49; 313/309

[56] References Cited

U.S. PATENT DOCUMENTS

| | | | |
|---|---|---|---|
| 3,735,186 | 5/1973 | Klopfer et al. | 313/346 R |
| 4,324,854 | 4/1982 | Beauchamp et al. | 430/31 |
| 5,023,110 | 6/1991 | Nomura et al. | 427/49 |
| 5,066,883 | 11/1991 | Yoshioka et al. | 313/309 |
| 5,320,703 | 6/1994 | Ikeda et al. | 117/68 |

FOREIGN PATENT DOCUMENTS

| | | |
|---|---|---|
| 06062663 | 6/1994 | European Pat. Off. . |
| 1-019658 | 1/1989 | Japan . |
| 64-031332 | 2/1989 | Japan . |
| 1-186740 | 7/1989 | Japan . |
| 1-283749 | 11/1989 | Japan . |
| 1-309242 | 12/1989 | Japan . |
| 2-257552 | 10/1990 | Japan . |

OTHER PUBLICATIONS

"The Emission of Hot Electrons and the Field Emission of Electrons from Tin Oxide", Radio Engineering and Electronic Physics (English Edition), Jul. 1965, pp. 1290–1296.

"Electrofoming and Electron Emission of Carbon Thin Films", Journal Of The Vacuum Society Of Japan, vol. 26, No. 1, pp. 22–29.

"Operation of Tunnel–Emission Devices" Journal Of Applied Physics, Jan–Dec. 1961, Vol. 32, pp. 646–652.

"Electrical Conduction and Electron Emission of Discontiuous Thin Films", G. Dittmer, Thin Solid Films, 9 (1972) pp. 317–328.

"Field Emission", W.P. Dyke, et al., Advances In Electronics And Electron Physics, Vol. VIII, 1956, pp. 89–185.

"Physical properties of thin–film field emission cathodes with molybdenum cones", Journal Of Applied Physics, Dec. 1976, Vol. 47, No. 12, pp. 5248–5263.

"Strong Electron Emission from Patterned Tin–Indium Oxide Thin Films", International Electron Devices Meeting in Washington, D.C., 1975, pp. 519–521.

*Primary Examiner*—John Goodrow

*Attorney, Agent, or Firm*—Fitzpatrick, Cella, Harper & Scinto

[57] ABSTRACT

In a manufacture method of an electron-emitting device in which an electro-conductive film having an electron-emitting region is provided between electrodes disposed on a substrate, a step of forming the electron-emitting region comprises a step of forming a structural latent image in the electro-conductive film, and a step of developing the structural latent image. An electron source comprising a plurality of electron-emitting devices arrayed on a substrate, and an image-forming apparatus in combination of the electron source and an image-forming member are manufactured by using the electron-emitting devices manufactured by the above method. The position and shape of an electron-emitting region of each electron-emitting device can be controlled so as to achieve uniform device characteristics, resulting less variations in the amount of emitted electrons between the electron-emitting devices and in the brightness of pictures. Also, the need of flowing a great current for formation of the electron-emitting region is eliminated and hence the current capacity of wiring can be reduced.

21 Claims, 27 Drawing Sheets

METHODS AND MANUFACTURING ELECTRON-EMITTING DEVICE, ELECTRON SOURCE, AND IMAGE-FORMING APPARATUS

BACKGROUND OF THE INVENTION

1. Field of the Invention

The present invention relates to a novel method of manufacturing electron-emitting devices, and methods of manufacturing electron sources and image-forming apparatus based on the novel manufacturing method of electron-emitting devices.

2. Related Background Art

There are hitherto known two major types of electron-emitting devices; i.e., thermionic cathode type electron-emitting devices and cold cathode type electron-emitting devices. Cold cathode type electron-emitting devices include the field emission type (hereinafter abbreviated to FE), the metal/insulating layer/metal type (hereinafter abbreviated to MIM), the surface conduction type, etc. Examples of FE electron-emitting devices are described in, e.g., W. P. Dyke & W. W. Dolan, "Field emission", Advance in Electron Physics, 8, 89 (1956) and C. A. Spindt, "PHYSICAL properties of thin-film field emission cathodes with molybdenium cones", J. Appl. Phys., 47, 5248 (1976).

One example of MIM electron-emitting devices is described in, e.g., C. A. Mead, "Operation of Tunnel-Emission Devices", J. Appl. Phys., 32, 646 (1961).

One example of surface conduction electron-emitting devices is described in, e.g., M. I. Elinson, Radio Eng. Electron Phys., 10, 1290, (1965).

Surface conduction electron-emitting devices operate based on a phenomenon that when a thin film of small area is formed on a substrate and a current is supplied to flow parallel to the film surface, electrons are emitted therefrom. As to such surface conduction electron-emitting devices, there have been reported, for example, one using a thin film of $SnO_2$ by Elinson cited above, one using an Au thin film [G. Dittmer: Thin Solid Films, 9, 317 (1972)], one using a thin film of $In_2O_3/SnO_2$ [M. Hartwell and C. G. Fonstad: "IEEE Trans. ED Conf.", 519 (1975)], and one using a carbon thin film [Hisashi Araki, et. al.: Vacuum, Vol. 26, No. 1, 22 (1983)].

As a typical example of those surface conduction electron-emitting devices, FIG. 27 schematically shows the device configuration proposed by M. Hartwell, et. al. in the above-cited paper. In FIG. 27, denoted by reference numeral 1 is a substrate. 4 is an electro-conductive thin film formed of, e.g., a metal oxide thin film made by sputtering into an H-shaped pattern, in which an electron-emitting region 5 is formed by energization treatment called energization forming (described later). Incidentally, the spacing L between opposed device electrodes is set to 0.5–1.0 mm and the width W' of the electro-conductive thin film is set to 0.1 mm.

The configuration of surface conduction electron-emitting devices is not limited to the H-pattern mentioned above. By way of example, a surface conduction electron-emitting device may be constructed such that opposite portions of the H-pattern are formed as electrodes and an electro-conductive thin film is formed to interconnect the electrodes. In this configuration, the electrodes and the electro-conductive thin film may be different in material and thickness from each other.

In those surface conduction electron-emitting devices, it has been customary that, before starting the emission of electrons, the electro-conductive thin film 4 is subjected to energization treatment called energization forming to form the electron-emitting region 5. Specifically, the term "energization forming" means applying a DC voltage or a voltage gradually increasing at a very slow rate of about 1 V/min, for example, across the electro-conductive thin film 4 to locally destroy, deform or denature it, to thereby form the electron-emitting region 5 which has been transformed into an electrically high-resistance state. In the electron-emitting region 5, a fissure or fissures are produced in part of the electro-conductive thin film 4 and electrons are emitted from the vicinity of the fissure(s) when a voltage is applied to the electro-conductive thin film 4 so that a current flows through the device.

The surface conduction electron-emitting device is simple in structure and easy to manufacture, and hence has an advantage that a number of devices can be formed into an array having a large area. Therefore, a variety of application studies with a view of utilizing such advantageous features of the surface conduction electron-emitting device have, been conducted. Typical application fields includes, e.g., charged beam sources and display devices. As one example of applications in which a number of surface conduction electron-emitting devices are formed into an array, there is proposed an electron source that, as described later in detail, surface conduction electron-emitting devices are arrayed in parallel, opposite ends of the individual devices are interconnected by two wires (called also common wires) to form one row, and a number of rows are arranged to form a matrix pattern. (See, e.g., Japanese Patent Application Laid-Open No. 64-031332, No. 1-283749 and No. 2-257552). In the field of image-forming apparatuses such as display devices, particularly, plane type display devices using liquid crystals have recently become popular instead of CRTs, but they are not self-luminous and have a problem of requiring back-lights or the like. Development of self-luminous display devices have therefore been desired. An image-forming apparatus is proposed in which an electron source having an array of numerous surface conduction electron-emitting devices and a fluorescent film radiating visible light upon impingement of electrons emitted from the electron source are combined with each other to form a display device. (See, e.g., U.S. Pat. No. 5,066,883).

In the known manufacture method, the forming step of forming the electron-emitting region is performed by applying a voltage to the electro-conductive thin film as explained above. With the Joule heat generated by the voltage applied, the electro-conductive thin film is partly denatured and deformed into a highly resistant state. That method has, however, had problems as noted below.

(1) Problem on control of position and shape of electron-emitting region:

The position where the electro-conductive thin film is denatured and deformed depends on various factors, but an important factor is in which part of the electro-conductive thin film the temperature is most substantially raised due to the heat generated.

If the electro-conductive thin film is uniform and the device electrodes have good symmetry, it is believed that the temperature is most substantially raised just at the middle between the electrodes. In practice, however, various factors bring about non-uniformity in the electro-conductive thin film, and symmetry of the electrode shape is often not satisfactory when the electrodes are formed by printing or the like. Also, it is believed that a high-resistance portion serving as the electron-emitting region is formed through a complex process in which when one high-resistance portion is formed in part of the electro-conductive thin film, current distribution is changed correspondingly, whereupon a next high-resistance portion is formed in the part in which the current is newly concentrated. Due to a slight disturbance, therefore, the shape of the electron-emitting region may have different widths depending on parts or may extend in a zigzag direction. This poses a difficulty in providing even device characteristics. In particular, when an electron source comprising an array of numerous electron-emitting devices and an image display device using the electron source are fabricated, the amount of emitted electrons and the brightness of pictures may vary.

For example, when an electron source is employed in an image display device having a large area, it is generally desired to form wiring and electrodes by screen printing from the standpoint of production techniques. In this case, however, the spacing between device electrodes opposed to each other is fairly wider than that based on film-forming by vacuum evaporation or sputtering and patterning by photolithography. This may lead to a problem that the electron-emitting region is more liable to extend in a zigzag direction.

(2) Problem on current capacity of wiring due to large forming current:

The step of the energization forming requires a much greater current than during the normal operation as an electron-emitting device. In particular, when an electron source comprising an array of numerous electron-emitting devices is fabricated, the forming treatment is generally carried out on a plurality of devices at a time (e.g., for each row of a matrix pattern of devices). In this case, it is required to flow a considerably greater current than when the electron-emitting devices are normally driven, and hence the wiring is required to have a current capacity for the current supplied. But once the forming treatment is completed, the current capacity actually required in the normal operation is reduced to a much lower level. Therefore, if such a large difference in the current capacity is eliminated, merits from the standpoint of production techniques are expected in points of, e.g., enabling a narrower width of the wiring and increasing the degree of freedom in apparatus design.

Further, because a great current flows through the wiring, a voltage drop is so increased that the state resulting from the forming treatment may be varied in the direction of the wiring to produce a systematic distribution in characteristics of electron emission.

To solve the problems as mentioned above, there has been a demand for establishing a novel method of manufacturing electron-emitting devices.

SUMMARY OF THE INVENTION

An object of the present invention is to enable the position and shape of an electron-emitting region of an electron-emitting device to be controlled, and to achieve uniform device characteristics. For an electron source comprising a plurality of electron-emitting devices and an image-forming apparatus using the electron source, an object of the present invention is to suppress variations in the amount of emitted electrons between the electron-emitting devices, reduce variations in the brightness of pictures, and to realize display of images with high quality.

Another object of the present invention is to eliminate the need of flowing a great current for formation of an electron-emitting region, thereby affording such merits from the standpoint of production techniques as that the current capacity of wiring can be reduced, the degree of freedom in apparatus design can be increased, and the production cost can be cut down.

Still another object of the present invention is to provide method of manufacturing electron-emitting devices, electron sources, and image-forming apparatuses which satisfy the demands mentioned above.

The present invention has been accomplished with a view of achieving the above objects.

According to an aspect of the present invention, there is provided a method of manufacturing an electron-emitting device in which an electro-conductive film having an electron-emitting region is provided between electrodes disposed on a substrate, wherein a step of forming the electron-emitting region comprises a step of forming a structural latent image in the electro-conductive film, and a step of developing the structural latent image.

According to another aspect of the present invention, there is provided a method of manufacturing an electron source comprising a plurality of electron-emitting devices arrayed on a substrate, wherein the electron-emitting devices are each manufactured by the method as set forth above.

According to still another aspect of the present invention, there is provided a method of manufacturing an image-forming apparatus in combination of an electron source comprising an array of electron-emitting devices and an image-forming member, wherein the electron-emitting devices are each manufactured by the method as set forth above.

BRIEF DESCRIPTION OF THE DRAWINGS

FIG. 5A shows triangular wave pulses having a fixed crest value and FIG. 5B shows triangular wave pulses having a gradually increased crest value.

DETAILED DESCRIPTION OF THE PREFERRED EMBODIMENTS

First of all, the term "structural latent image" used in this application implies a portion of an electro-conductive thin film (serving as an electron-emitting region) in which the electro-conductive thin film itself or local environment thereof has a different structure from surroundings, and which is structurally more unstable than the surroundings and is more liable to denature and deform into a high-resistance state when treated by any developing method.

Specifically, the structural latent image implies a portion of an electro-conductive thin film in which a film thickness is different from that of the surroundings or the film has a different microstructure (morphology), or which is in contact with a structure such as a groove and a projection, or with a substance bringing about any reaction with the electro-conductive thin film.

The term "developing method" comprises, e.g., application of heat such as effected by substantially uniform heating from the exterior, local heating with a scanned laser spot, and self-heating with Joule heating or the like. In addition, the developing method includes one of exposing the desired portion of an electro-conductive thin film to a proper atmosphere to cause any reaction, and one of immersing the desired portion of an electro-conductive thin film in acid or the like to erode it. Two or more of the above methods may be used in a combined manner.

While the heating method will be described below, by way of example, as heating with Joule heating, this differs from the conventional energization forming. In the present invention, heating is required just to such an extent that the structural latent image is developed, and hence the required electric power is much smaller than required in the conventional forming treatment.

Using any of the above methods can prevent the position of the electron-emitting region from being unstable and from moving in a zigzag direction or so due to slight disturbance as mentioned above. Also, it is thought that the dynamic mechanism for formation of the electron-emitting region is dominated more strongly by structural instability of the structural latent image itself than by the above-explained concentration in current distribution. Therefore, non-uniformity in width of the electron-emitting region is suppressed and, as a result, variations in characteristics of electron-emitting devices are suppressed.

The arrangement and operation of the present invention will be described below in detail in connection with preferred embodiments.

Figure 1A:
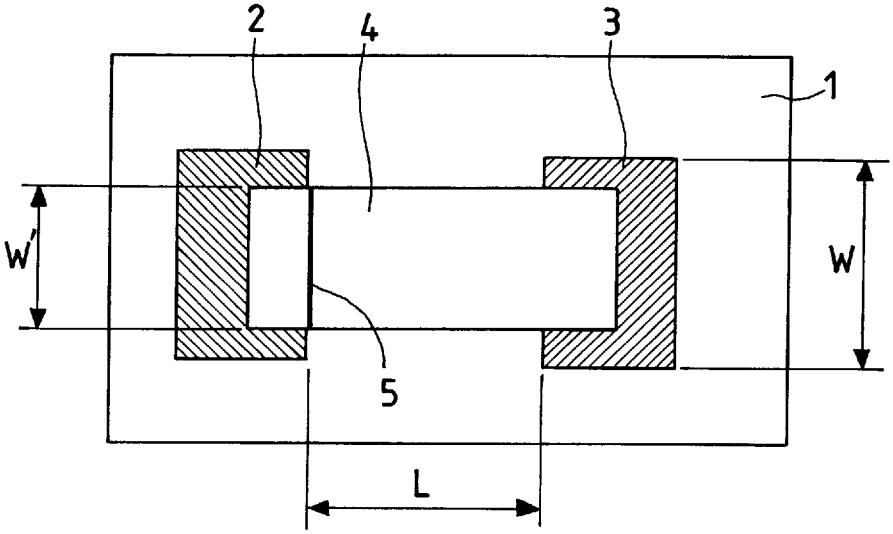
FIGS. 1A and 1B are schematic views showing a first example of the structure of a surface conduction electron-emitting device manufactured by the present invention.
Figure 1B:
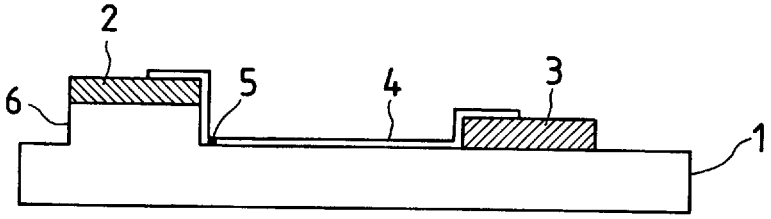

FIGS. 1A and 1B schematically show one example of the basic structure of a surface conduction electron-emitting device of the present invention.

In FIGS. 1A and 1B, denoted by 1 is a substrate, 2 and 3 are device electrodes, 4 is an electro-conductive thin film, 5 is an electron-emitting region, and 6 is a height restricting member which constitutes part of structural latent image forming means.

The substrate 1 can be made of any of various glasses such as quartz glass, glass containing an impurity such as Na in reduced content, soda lime glass, and glass having a coating layer of $SiO_2$ on soda lime glass by, e.g., sputtering, ceramics such as alumina, or Si.

The device electrodes 2, 3 opposed to each other can be made of any of usual conductive materials. By way of example, a material for the device electrodes may be selected from metals such as Ni, Cr, Au, Mo, W, Pt, Ti, Al, Cu and Pd or alloys thereof, printing conductors comprising metals or metal oxides such as Pd, Ag, Au, $RuO_2$ and Pd—Ag, glass and so on, transparent conductors such as $In_2O_3$–$SnO_2$, and semiconductors such as polysilicon.

The spacing L between the device electrodes, the length W of each device electrode, the width W' of the electroconductive thin film 4, etc. are designed in view of the form of application and other conditions. The spacing L between the device electrodes is preferably in the range of several hundreds nm to several hundreds μm, more preferably in the range of several μm to several tens μm.

In consideration of a resistance value between the device electrodes, limitations on an array of numerous electron-emitting devices, etc., the length W of each device electrode can be set in the range of several μm to several hundreds μm. The film thickness d of the device electrodes 2, 3 can be set in the range of several tens nm to several μm.

In one example of the device configuration shown in FIGS. 1A and 1B, the structural latent image forming means is provided as a step made up by the device electrode 2 and the height restricting member 6 formed by projected part of the substrate 1 underlying the device electrode 2. When a step between the device electrode and the substrate is used as the structural latent image forming means in that way, the step may also be provided by modifying the device electrode itself. Specifically, by forming a pair of device electrodes so that one of the device electrodes has a greater thickness than the other, the step between the thicker device electrode and the substrate can serve as the structural latent image forming means.

Figure 2A:
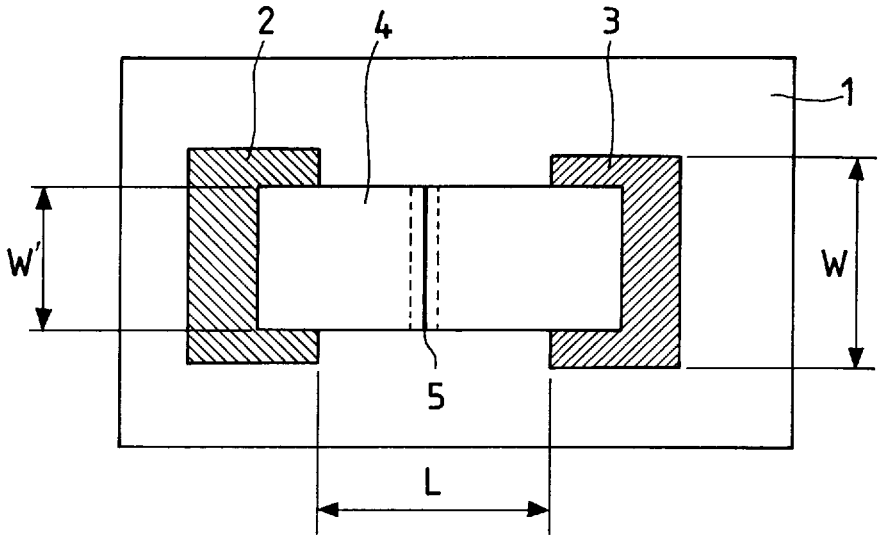
FIGS. 2A and 2B are schematic views showing a second example of the structure of a surface conduction electron-emitting device manufactured by the present invention.
Figure 2B:
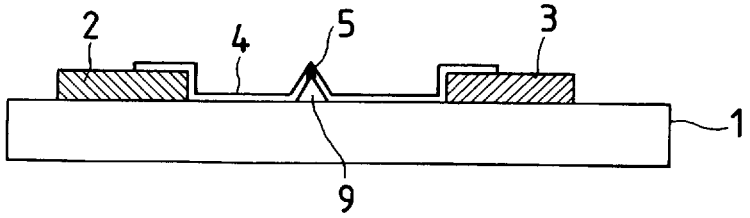

As another example of the structural latent image forming means for use in the present invention, a step can be provided by a step forming member 9 made of an insulator such as $SiO_2$ formed between the device electrodes 2 and 3, as shown in FIGS. 2A and 2B.

In the case where a step between the device electrode and the substrate is employed as the structural latent image forming means, the step height is set in consideration of both the film morphology depending on the manufacture method of the electro-conductive thin film 4 and the film thickness. The step height is preferably three or more times the thickness of the electro-conductive thin film, more preferably ten or more times the film thickness.

Figure 3A:
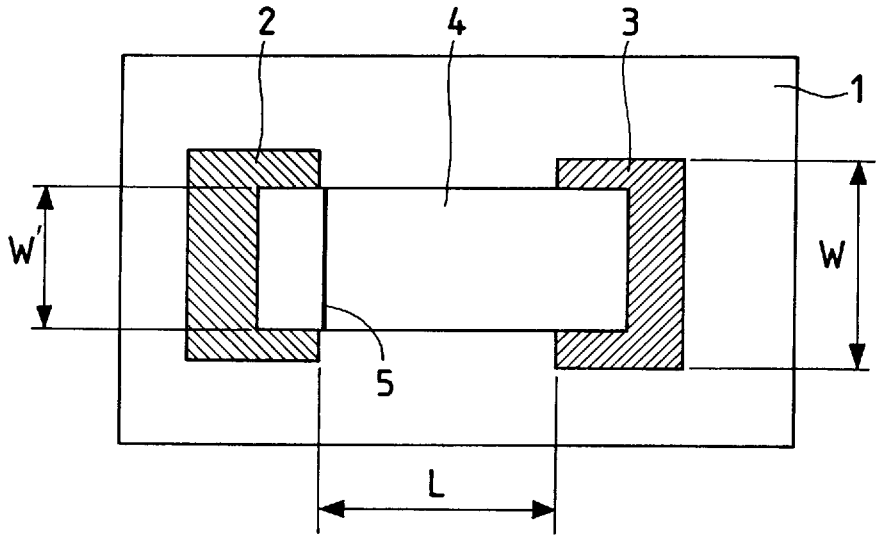
FIGS. 3A and 3B are schematic views showing a third example of the structure of a surface conduction electron-emitting device manufactured by the present invention.
Figure 3B:
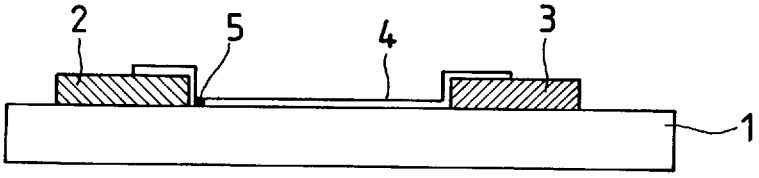

Still another example of the structural latent image forming means for use in the present invention may be provided by, as shown in FIGS. 3A and 3B, forming the device electrodes 2, 3 of different materials and selecting the materials such that the material of one electrode brings about any reaction with the material of the electro-conductive thin. film to cause deformation or denaturization of the latter at a certain temperature, for example, but there will not occur any significant reaction between the other electrode and the electro-conductive thin film at that temperature. In this case, a contact portion between the one electrode and the electro-conductive thin film serves as the structural latent image.

In order to provide good characteristics of electron emission, it is preferable that the electro-conductive thin film 4 be made up by fine particles. The thickness of the electro-conductive thin film 4 is appropriately set in consideration of step coverage to the device electrodes 2, 3, a resistance value between the device electrodes 2, 3, conditions of the forming-treatment (described later), and so on. In general, the film thickness is preferably in the range of several 0.1 nm to several hundreds nm, more preferably in the range of 1 nm to 50 nm. Also, the electro-conductive thin film 4 has a resistance value Rs in the range of 102 to 107 Ω/□. Note that Rs is determined based on R=Rs(l/w) where R is resistance of a thin film having a thickness of t, a width of w and a length of l.

Practical examples of a material used to form the electro-conductive thin film 4 include metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZeN and HfN, semiconductors such as Si and Ge, and carbon.

The term "fine particle film" used herein means a film comprising a number of fine particles aggregated together, and includes films having microstructures in which fine particles are not only individually dispersed, but also adjacent to or overlapped with each other (including a microstructure in which some fine particles are aggregated in groups so as to form islands as a whole). The particle size of the fine particles is in the range of several 0.1 nm to several hundreds nm, preferably 1 nm to 20 nm.

As there often appears the term "fine particle" in this specification, the meaning of this term will be explained.

A small particle is called a "fine particle" and a particle smaller than the fine particle is called an "ultra fine particle". It is also customary that a particle smaller than the ultra fine particle and consisted of atoms in number of a hundred or less is called a "cluster".

However, the boundary between particle sizes represented by the respective terms is not strict, but varies depending on which property is taken into consideration when classifying small particles. "Fine particle" and "ultra fine particle" are both often called "fine particle" together, and this specification employs this rule. "Experimental Physics Lecture 14 Surface-Fine Particle", (compiled by Koreo Kinoshita, Kyoritsu Publishing, published Sep. 1, 1986) reads as follows. "It is assumed that, when the term "fine particle" is used in this Lecture, it means particles having a diameter roughly ranging from 2–3 μm to 10 nm, and the term "ultra fine particle" is especially used, it means particles having a particle size roughly ranging from 10 nm to 2–3 nm. Both the particles are often simply expressed as "fine particle" together, and the above-mentioned ranges are never strictly delimited, but should be understood as a guideline. When the number of atoms making up a particle is on the order of from 2 to several tens to several hundreds, the particle is called a cluster." (page 195, lines 22–26) Additionally, based on the definition of "ultra fine particle" made by "Hayashi-Ultra Fine Particle Project" in New Technology Development Operation Group of Japan, a lower limit of the particle size is lower than above as follows. "In "Ultra Fine Particle Project" (1981–1986) according to Creative Science & Technology Promotion System, we decided to call a particle having a particle size (diameter) in the range of about 1 to 100 nm as "ultra fine particle". Based on this definition, one ultra fine particle is an aggregate of atoms in number roughly 100 to $10^8$. Looking from the atomic scale, the ultra fine particle is a large or extra large particle." ("Ultra Fine Particle—Creative Science & Technology —", compiled by Chikara Hayashi, Ryoji Ueda,. and Akira Tasaki; Mita Publishing, 1988, page 2, lines 1 to 4); and "A particle smaller than the ultra fine particle, that is to say, one particle consisted of atoms in number several to several hundreds is usually called a cluster.", (Ibid., page 2, lines 12 to 13).

In view of the above phraseology generally employed, the term "fine particle" used in this specification is assumed to mean an aggregate of numerous atoms and/or molecules having a particle size of which lower limit is roughly from several 0.1 nm to 1 nm and upper limit is roughly about several μm.

The electron-emitting region 5 is constituted by a high-resistance fissure developed in part of the electro-conductive thin film 4, and is formed depending on the thickness, properties and material of the electro-conductive thin film 4, the manner of the forming treatment (described later), and so on. In the electron-emitting region 5, there may exist electro-conductive fine particles having a particle size in the range of several 0.1 nm to several tens nm. The electro-conductive fine particles contain part or all of elements making up a material of the electro-conductive thin film 4. The electron-emitting region 5 and the electro-conductive thin film 4 in the vicinity thereof may contain carbon and carbon compounds.

Figure 4A:
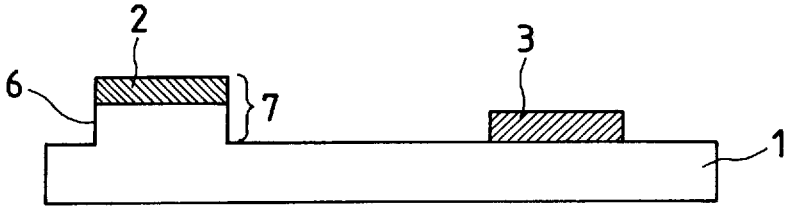
FIGS. 4A to 4C are schematic views for explaining a manufacture process for the first example of the-structure of a surface conduction electron-emitting device manufactured by the present invention.
Figure 4B:
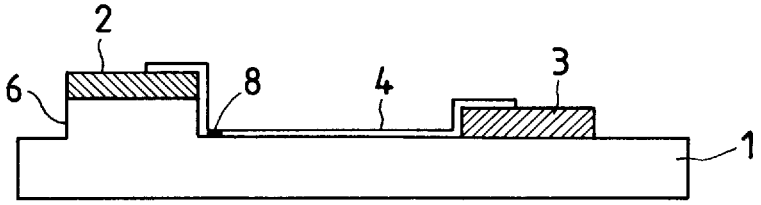
Figure 4C:
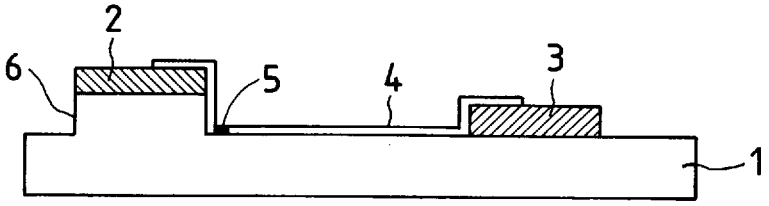

Taking as an example the electron-emitting device constructed as shown in FIGS. 1A and 1B, one example of manufacturing methods will be described below following successive steps with reference to FIGS. 4A to 4C.

(1) Step of forming structural latent image forming means.

The substrate 1 is sufficiently washed with a detergent, pure water, an organic solvent and so on. Then, a resist pattern is formed over a region in which one of the device electrodes (the device electrode 2 in FIGS. 1A and 1B) is to be formed, and the substrate 1 is etched by reactive ion etching (RIE) with the resist pattern used as a mask, thereby forming the height restricting member 6 which determines the position where a step serving as the structural latent image forming means is provided. A device electrode material is then deposited on the substrate by vacuum vapor deposition, sputtering or the like. After that, the deposited material is patterned by photolithography, for example, to form the device electrodes 2, 3 on the substrate 1 (FIG. 4A). A step 7 provided by the-height restricting member 6 formed by etching and the device electrode 2 formed thereon functions as the structural latent image forming means.

While the height restricting member 6 is here described as being formed by etching the substrate, it may be formed by depositing a suitable material on the substrate.

(2) Step of forming electro-conductive thin film having structural latent image.

Over the substrate 1 including the device electrodes 2, 3 formed thereon, an organic metal solution is coated to form an organic metal thin film. As the organic metal solution, a solution of an organic metal compound containing, as a primary element, the same metal as a material of the electro-conductive thin film 4 can be used. The organic metal thin film is heated for calcination and then patterned by lift-off, etching or the like to form the electro-conductive thin film 4. At this time, a structural latent image 8 is formed in the electro-conductive thin film 4 in accordance with the step 7 as the structural latent image forming means. (FIG. 4B).

In this case, the structural latent image 8 is formed along a lower edge of the step 7 in contact with the substrate due to the fact that the electro-conductive thin film is coated over the device electrode 3 having a small step with good step coverage, but it is coated over the device electrode 2 having a large step with poor step coverage.

While the organic metal solution is here described as being applied to the substrate 1 by coating, the electro-conductive thin film 4 can be formed by not only simple coating, but also vacuum vapor deposition, sputtering, chemical vapor deposition, dispersion coating, dipping, spinner coating, etc.

(3) Step of developing structural latent image

While the structural latent image can be developed by various methods, it is here developed as one example by a method of heating the device almost uniformly. Thus, the device is introduced into a heating furnace and left there under heating at a proper temperature. As a result, the structural latent image formed in the electro-conductive thin film 4 develops change in the microstructure to finally establish a high-resistance state.

The phenomenon will hereinafter be referred to as "development of the structural latent image".

(4) Activating step

After the forming treatment, the electron-emitting device is preferably subjected to treatment called an activating step. The activating step is a step for remarkably changing a device current If and an emission current Ie.

Figure 5A:
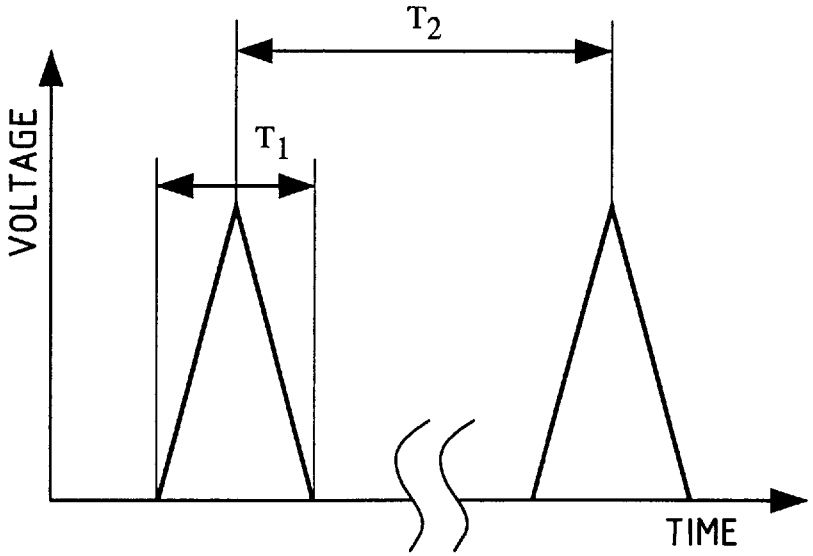
FIGS. 5A and 5B are charts showing waveforms of pulses applied in the activating step, etc.
Figure 5B:
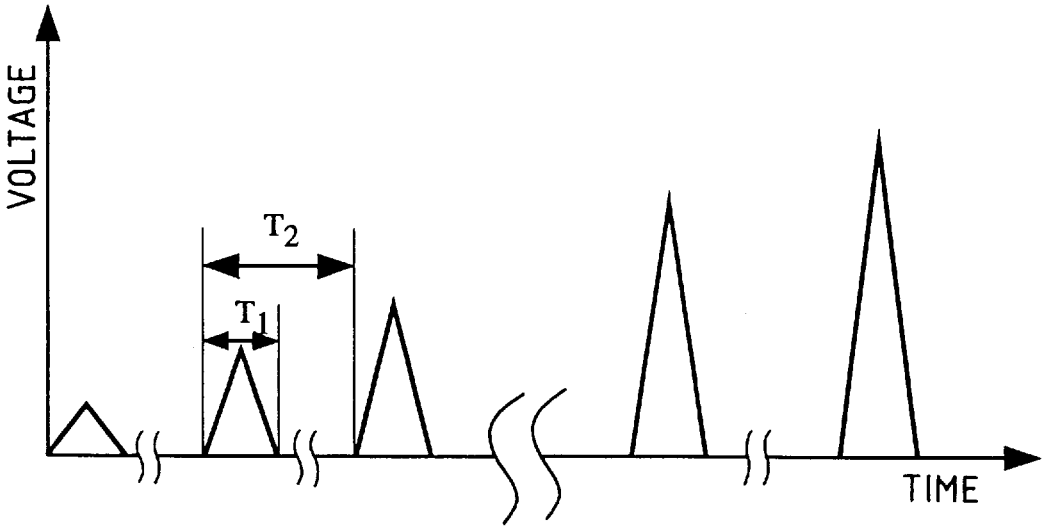

The activating step can be performed by repetitively applying triangular wave pulses as shown in FIGS. 5A and 5B, for example, in an atmosphere containing gas of an organic material. The pulses may have a crest value kept fixed as shown in FIG. 5A, or gradually varied as shown in FIG. 5B. Both the types of pulses may be used in a combined manner. A suitable train of pulses is selected case by case depending on the conditions and purpose.

The above atmosphere is obtained, for example, by evacuating a vacuum container (envelope) by an oil diffusion pump, a rotary pump or the like and utilizing organic gas remained in an atmosphere inside the vacuum container, or by evacuating a vacuum container by an ion pump to once create a sufficiently high degree of vacuum and then introducing gas of a suitable organic material to the vacuum space. A preferable gas pressure of the organic material at this time depends on the form of application, the configuration of the vacuum container, the kind of organic material, etc. and, hence, it is appropriately set case by case. Examples of suitable organic materials include aliphatic hydrocarbons such as alkanes, alkenes and alkynes, aromatic hydrocarbons, alcohols, aldehydes, ketones, amines, and organic acids such as phenol, carboxylic acid and sulfonic acid. More specifically, the suitably usable organic materials are saturated hydrocarbons expressed by $C_nH_{2n+2}$ such as methane, ethane and propane, unsaturated hydrocarbons expressed by $C_nH_{2n}$, such as ethylene and propylene, benzene, toluene, methanol, ethanol, formaldehyde, acetoaldehyde, acetone, methyl ethyl ketone, methylamine, ethylamine, phenol, formic acid, acetic acid, propionic acid, etc. As a result of the activating step, carbon or carbon compounds are deposited on the device from the organic material present in the atmosphere so that the device current If and the emission current Ie are substantially changed.

The timing to finish the activating step is determined while measuring the device current If and the emission current Ie. The width, interval and crest value of the applied pulses are appropriately set. The pulse waveform is not limited to the illustrated triangular wave, but any other suitable waveform such as a rectangular wave can also be employed.

The carbon or the carbon compounds are in the form of graphite such as HOPG (Highly Oriented Pyrolitic Graphite), PG (Pyrolitic Graphite), and GC (Glassy Carbon) (HOPG means graphite having a substantially complete crystal structure, PG means graphite having a crystal grain size of about 20 nm and a crystal structure slightly disordered, and GC means graphite having a crystal grain size of about 2 nm and a crystal structure more disordered), or amorphous carbon (including amorphous carbon alone and a mixture of amorphous carbon and fine crystals of any above graphite). The thickness of the deposited carbon or carbon compounds is preferably not larger than 50 nm, more preferably not larger than 30 nm.

(5) Stabilizing step

It is preferable that the electron-emitting device obtained through the above steps be subjected to a stabilizing step. This stabilizing step is a step of evacuating the organic material from the vacuum container. A vacuum evacuating apparatus used to evacuate the vacuum container is preferably of the type using no oil so that device characteristics will not be affected by the oil generated from the evacuating apparatus. Specifically, examples of such a vacuum evacuating apparatus includes a sorption pump, an ion pump or the like.

When the previous activating step is performed by using an oil diffusion pump or a rotary pump as the evacuating apparatus and utilizing organic gas resulted from an oil component generated from the pump, a partial pressure of the oil component is required to be suppressed to a level as low as possible. The partial pressure of the organic component in the vacuum container is preferably $1\times10^{-6}$ Pa or less, more preferably $1\times10^{-8}$ Pa or less, at which pressure substantially no carbon and carbon compounds will newly be deposited on the device. While the vacuum container is being evacuated, it is preferable to heat the whole of the vacuum container, causing organic material molecules adsorbed onto inner walls of the vacuum container and the electron-emitting device to be more easily evacuated. At this time, it is desired that the vacuum container be heated at 80° to 250° C. for 5 hours or longer. However, the heating conditions are not limited to those ones, but are appropriately selected depending on various factors such as the size and shape of the vacuum container and the configuration of the electron-emitting device. The pressure in the vacuum container is required to be kept as low as possible and hence is preferably $1\times10^{-5}$ Pa or less, more preferably $1\times10^{-6}$ Pa or less.

The atmosphere in which the electron-emitting device is driven after the stabilizing step is preferably maintained in the same atmosphere as achieved just after the stabilizing step, but this condition is not strictly required. If the organic material is sufficiently removed, satisfactorily stable characteristics can be maintained even if the degree of vacuum is slightly reduced.

By establishing the vacuum atmosphere as mentioned above, it is possible to prevent deposition of new carbon or carbon compounds. As a result, the device current If and the emission current Ie are stabilized.

Basic characteristics of the electron-emitting device manufactured through the above-explained steps, to which the present invention is applicable, will be described below with reference to FIGS. 6 and 7.

Figure 6:
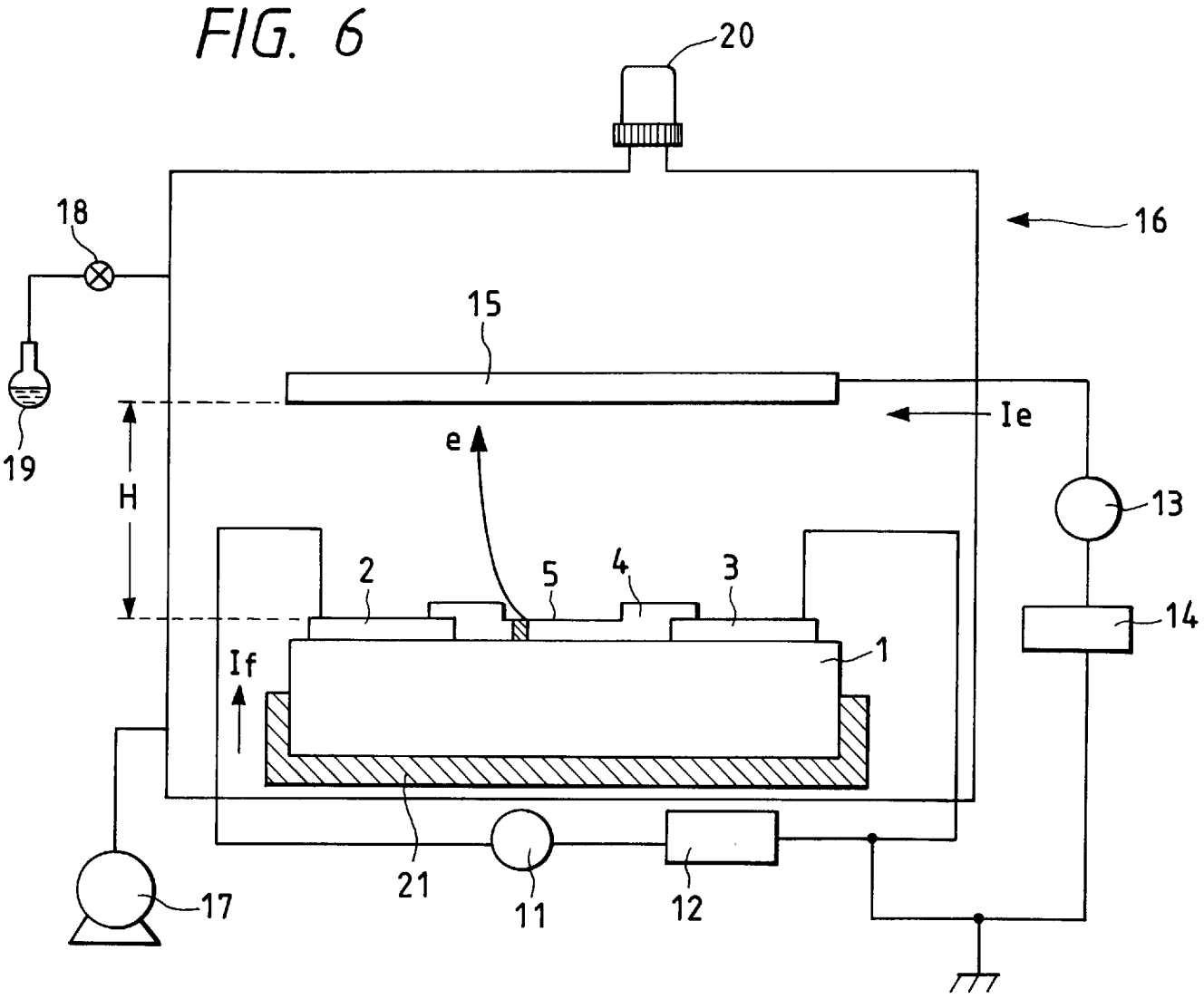
FIG. 6 is a diagram schematically showing one example of a vacuum treatment apparatus for use in the present invention.

FIG. 6 is a schematic view showing one example of a vacuum treatment apparatus which has not only a function of evaluating the device characteristics, but also a function of carrying out the above activating and stabilizing steps. In FIG. 6, identical parts to those in FIGS. 1A and 1B are denoted by the same reference numerals as those in FIGS. 1A and 1B. Referring to FIG. 6, denoted by 16 is a vacuum vessel and 17 is an evacuating apparatus. An electron-emitting device is placed in the vacuum vessel 16. The electron-emitting device comprises a substrate 1, device electrodes 2 and 3, an electro-conductive thin film 4, and an electron-emitting region 5. Further, 12 is a power supply for applying a device voltage Vf to the electron-emitting device, 11 is an ammeter for measuring a device current If flowing through the electro-conductive thin film 4 between the device electrodes 2 and 3, and 15 is an anode electrode for capturing an emission current Ie emitted from the electron-emitting region 5 of the device. Additionally, 14 is a high-voltage power supply for applying a voltage to the anode electrode 15, and 13 is an ammeter for measuring the emission current Ie emitted from the electron-emitting region 5 of the device. The measurement is performed, for example, by setting the voltage applied to the anode electrode to fall in the range of 1 kV to 10 kV, and the distance H between the anode electrode and the electron-emitting device to fall in the range of 2 mm to 8 mm.

Denoted by 18 is means for controlling the amount of an organic material which is introduced to the vacuum vessel in the above activating step when required. Specifically, this inflow amount control means 18 comprises various valves and a mass flow controller. 19 is a material source in the form of an ampule or a bomb.

Further, the vacuum vessel 16 is provided with atmosphere detecting means 20 comprising a vacuum gauge, a quadruple mass spectrometer (Q-mass) and so on which are necessary to measure an atmosphere, enabling the atmosphere in the vacuum vessel to be detected. By using the inflow amount control means 18 and the atmosphere detecting means 20 in a combined manner, a desired atmosphere can be created in the vacuum vessel. The evacuating apparatus 17 includes a normal high vacuum apparatus system comprising a turbo pump and a rotary pump, and a ultra-high vacuum apparatus system comprising an ion pump or the like. 21 is a sample holder for holding an electron-emitting device or an electron source. The sample holder 21 can be heated to 500° C. by a built-in heater (not shown). The whole of the vacuum treatment apparatus in which the electron source substrate is placed can be heated to 400° C. by a heater (not shown).

Figure 7:
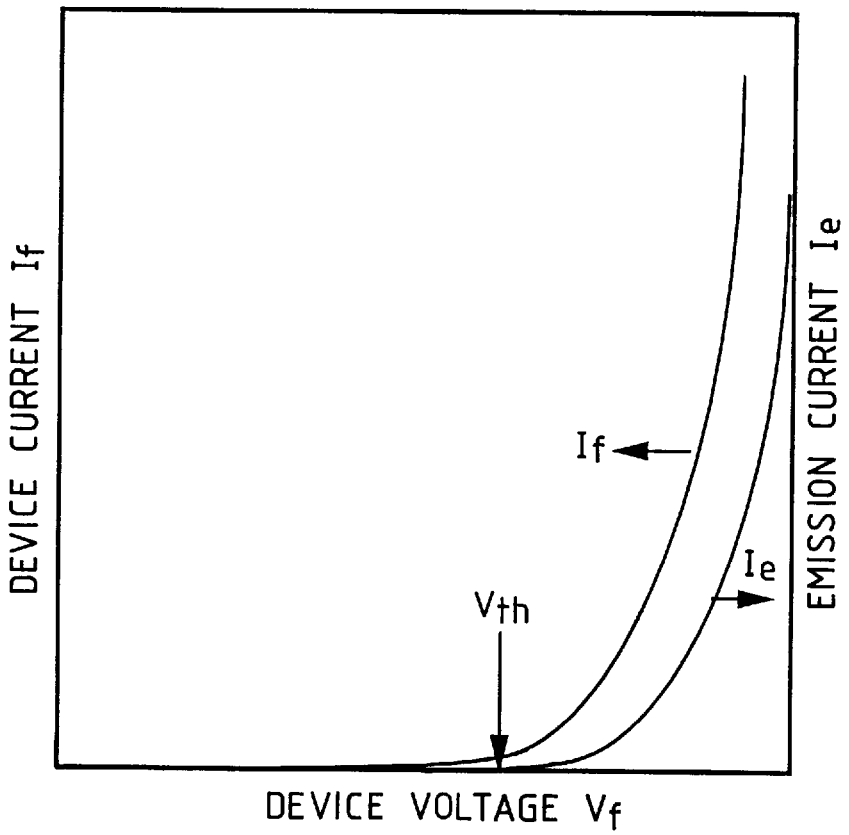
FIG. 7 is a graph showing current versus voltage characteristics of the surface conduction electron-emitting device manufactured by the present invention.

FIG. 7 is a graph plotting the relationship between the emission current Ie and the device current If and the device voltage Vf measured by using the vacuum treatment apparatus shown in FIG. 6. Note that the graph of FIG. 7 is plotted in arbitrary units because the emission current Ie is much smaller than the device current If. The vertical and horizontal axes each represent a linear scale.

As will be apparent from FIG. 7, the surface conduction electron-emitting device to which the present invention is applicable has three characteristic features with regard to the emission current Ie as follows.

(i) In the electron-emitting device, the emission current Ie is abruptly increased when the device voltage greater than a certain value (called a threshold voltage, Vth in FIG. 7) is applied, but it is not appreciably detected below the threshold voltage Vth. Thus, the electron-emitting device is a non-linear device having the definite threshold voltage Vth for the emission current Ie.

(ii) The emission current Ie increases monotonously depending on the device voltage Vf and, therefore, the emission current Ie can be controlled by the device voltage Vf.

(iii) Emitted charges captured by the anode electrode 15 depend on a period of time during which the device voltage Vf is applied. Thus, the amount of charges captured by the anode electrode 15 can be controlled with the time during which the device voltage Vf is applied.

As will be understood from the above explanation, electron emission characteristics of the surface conduction electron-emitting device, to which the present invention is applicable, can easily be controlled in response to an input signal. By utilizing this feature, applications to a variety of fields, including an electron source, an image-forming apparatus, etc. using an array of numerous electron-emitting devices are realized.

Further, in FIG. 7, the device current If increases monotonously with respect to the device voltage Vf (called MI characteristic hereinafter). The device current If may exhibit a voltage controlled negative resistance characteristic (called VCNR characteristic hereinafter) (not shown) with respect to the device voltage Vf. These characteristics of the device current can be selected by controlling the conditions in the above-explained manufacture steps.

Application examples of the electron-emitting device to which the present invention is applicable will be described below.

An electron source or an image-forming apparatus, for example, can be made up by arraying a number of surface conduction electron-emitting devices, to which the present invention is applicable, on a substrate.

The electron-emitting devices can be arrayed on a substrate by several methods.

By one method, a number of electron-emitting devices are arrayed side by side (in a row direction) and interconnected at both ends thereof in parallel by wires to form a row of electron-emitting devices, this row of electron-emitting devices being arranged in a large number. Control electrodes (called also grids) are disposed above the electron-emitting devices to lie in a direction (called a column direction) perpendicular to the row-directional wires for controlling emission of electrons from the electron-emitting devices. This is an electron source of ladder wiring type. By another method, a number of electron-emitting devices are arrayed in a matrix to lie in the X-direction and the Y-direction. Each of the opposed electrodes of the plural electron-emitting devices lying in the same row are connected in common to one X-directional wire, and the others of the opposed electrodes of the plural electron-emitting devices lying in the same column are connected in common to one Y-directional wire. This is an electron source of simple matrix wiring type. A description will first be made of the simple matrix wiring type in detail.

The surface conduction electron-emitting devices to which the present invention is applicable have the above-mentioned characteristics from (i) to (iii). In other words, electrons emitted from each of the surface conduction electron-emitting devices are controlled depending on the crest value and width of a pulse-like voltage applied to between the device electrodes opposed to each other when the applied voltage is higher than the threshold value. On the other hand, almost no electrons are emitted at the voltage lower than the threshold value. Based on these characteristics, even when the electron-emitting devices are arrayed in large number, it is possible to select any desired one of the electron-emitting devices and to control the amount of electrons emitted therefrom in response to an input signal by properly applying the pulse-like voltage to each corresponding device.

Figure 8:
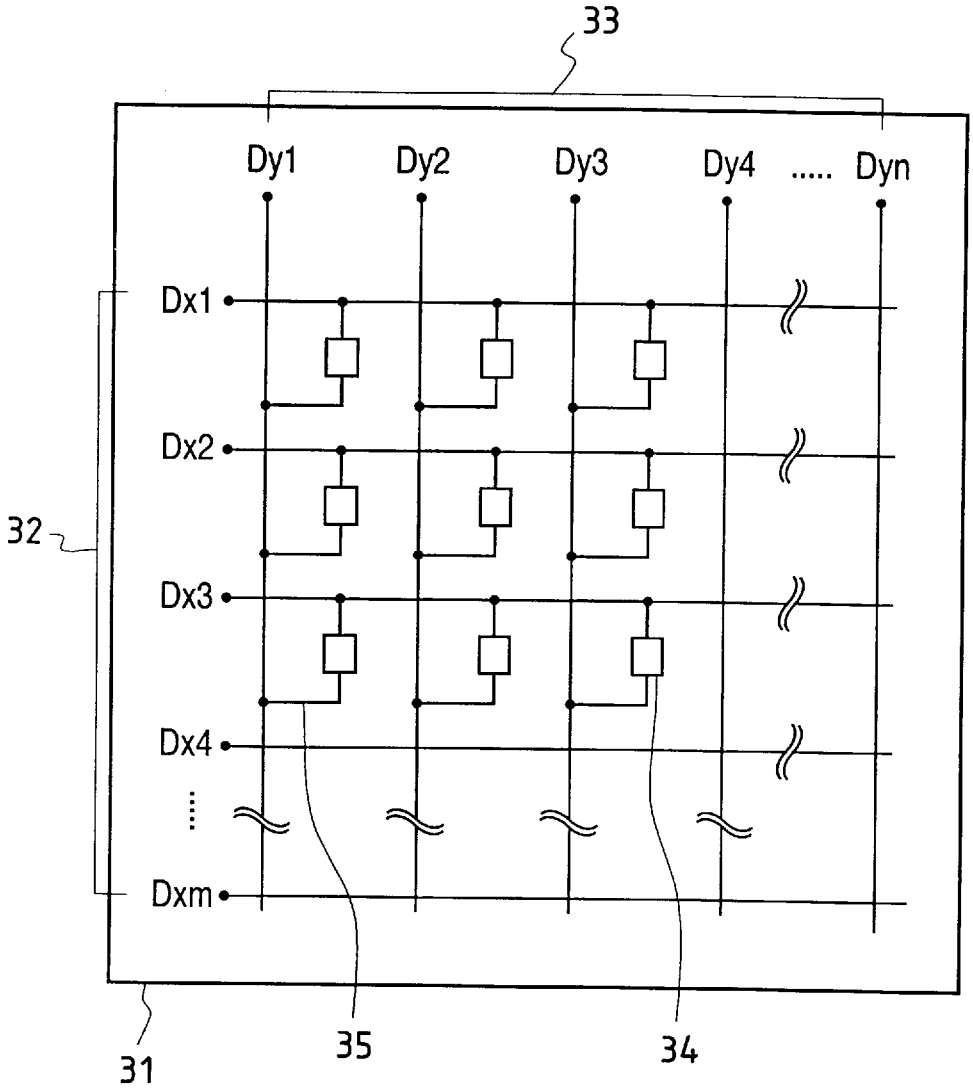
FIG. 8 is a diagram for explaining an electron source of matrix wiring type manufactured according to the present invention.

An electron source substrate constructed in accordance with the above principle by arranging a number of electron-emitting devices to which the present invention is applicable will be described below with reference to FIG. 8. In FIG. 8, denoted by 31 is an electron source substrate, 32 is an X-directional wire, 33 is a Y-directional wire, 34 is a surface conduction electron-emitting device, and 35 a connecting wire. The surface conduction electron-emitting device 34 may be manufactured by any of the above-explained methods.

Then, m lines of X-directional wires 32, indicated by Dx1, Dx2, . . . , Dxm, are formed of electro-conductive metal or the like by vacuum vapor deposition, printing, sputtering or the like. The material, film thickness and width of the wires are appropriately designed case by case. Also, the Y-directional wires 33 are made up of n lines of Dy1, Dy2, . . . , Dyn and are formed in a like manner to the X-directional wires 32. An interlayer insulating layer (not shown) is interposed between the m lines of X-directional wires 32 and the n lines of Y-directional wires 33 to electrically isolate the wires 32, 33 from each other. (Note that m, n are each a positive integer).

The not-shown interlayer insulating layer is made of $SiO_2$ or the like which is formed by vacuum vapor deposition, printing, sputtering or the like. By way of example, the interlayer insulating layer is formed in a desired shape so as to cover the entire or partial surface of the substrate 31 on which the X-directional wires 32 have been formed. The thickness, material and fabrication process of the interlayer insulating layer are appropriately set so as to endure the potential difference, particularly, in portions where the X-directional wires 32 and the Y-directional wires 33 intersect each other. The X-directional wires 32 and the Y-directional wires 33 are led out of the substrate to provide external terminals.

Respective paired electrodes (not shown) of the surface conduction electron-emitting devices 34 are electrically connected to the m lines of X-directional wires 32 and the n lines of Y-directional wires 33 as shown by the connecting wires 35 which are formed of electro-conductive metal or the like.

The material of the wires 32 and 33, the material of the connecting wires 35, and the material of the paired device electrodes may be the same in part or all of the constituent elements thereof, or may be different from one another. Those materials are appropriately selected, for example, from the materials explained above in connection with the device electrodes. Note that when the device electrodes and the wires are made of the same material, the term "device electrode" may be used to mean both a device electrode and a wire connected thereto together.

The X-directional wires 32 are electrically connected to scan signal applying means (not shown) for applying a scan signal to select each row of the surface conduction electron-emitting devices 34 which are arrayed in the X-direction. On the other hand, the Y-directional wires 33 are electrically connected to modulation signal generating means (not shown) for modulating each column of the surface conduction electron-emitting devices 34, which are arrayed in the Y-direction, in response to an input modulation signal. A driving voltage applied to each of the surface conduction electron-emitting devices is supplied as a differential voltage between the scan signal and the modulation signal both applied to that device.

With the above arrangement, the individual devices can be selected and driven independently of one another based on the simple matrix wiring.

Figure 9:
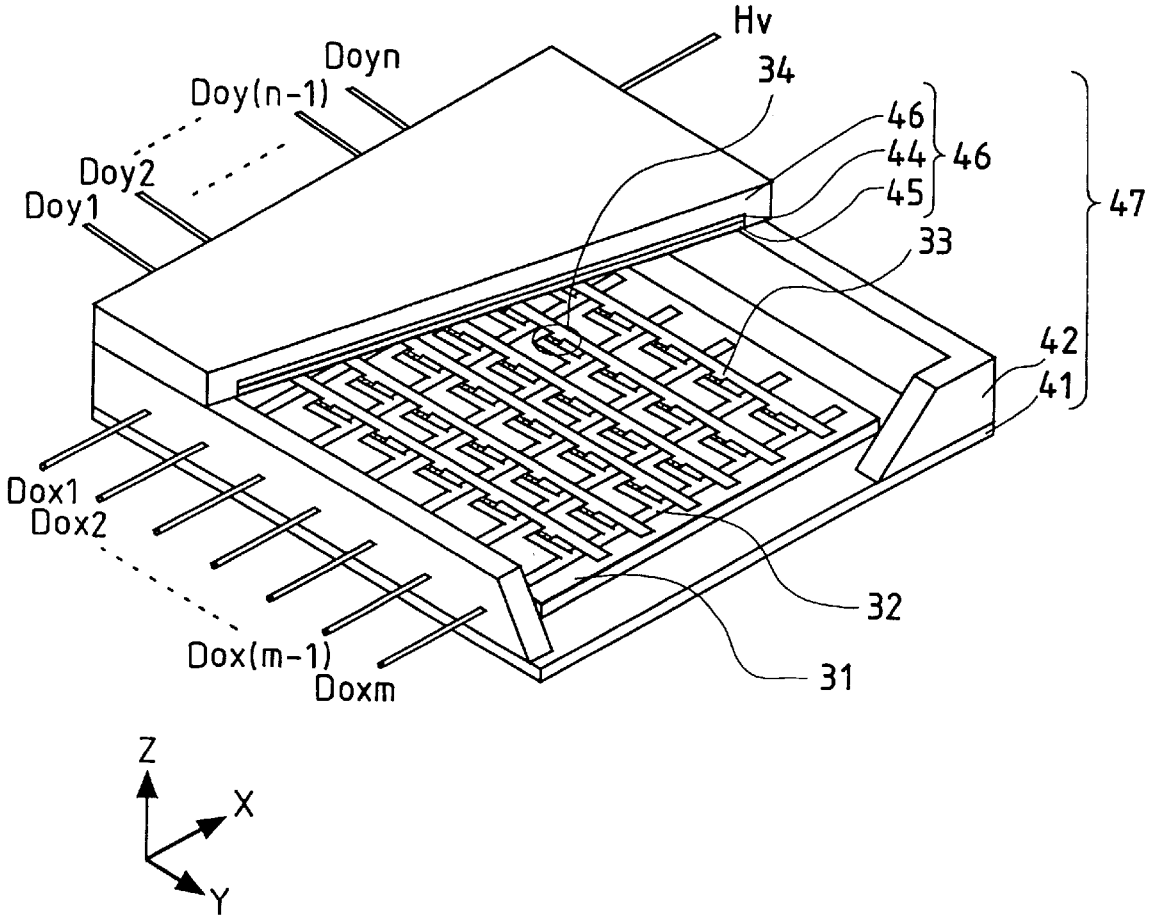
FIG. 9 is a perspective view, partly broken, schematically showing one example of an image-forming apparatus manufactured according to the present invention in which the electron source of matrix wiring type, an image display member, etc. are combined with each other.
Figure 10A:
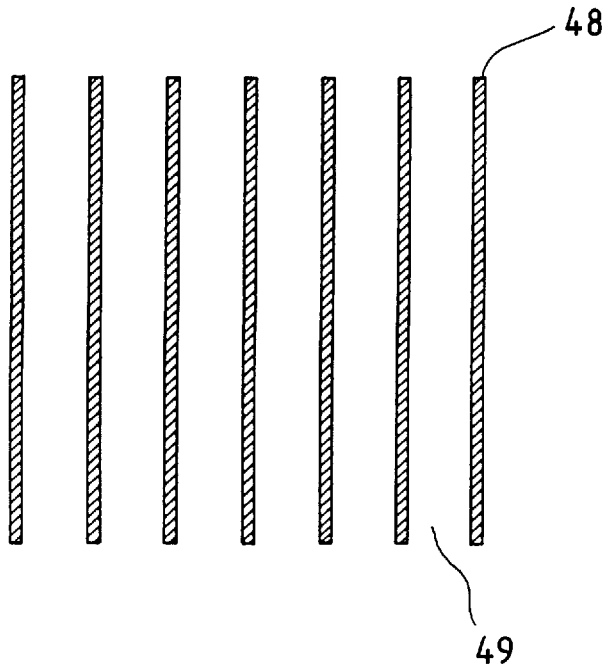
FIGS. 10A and 10B are schematic views for explaining arrangements of a fluorescent film.
Figure 10B:
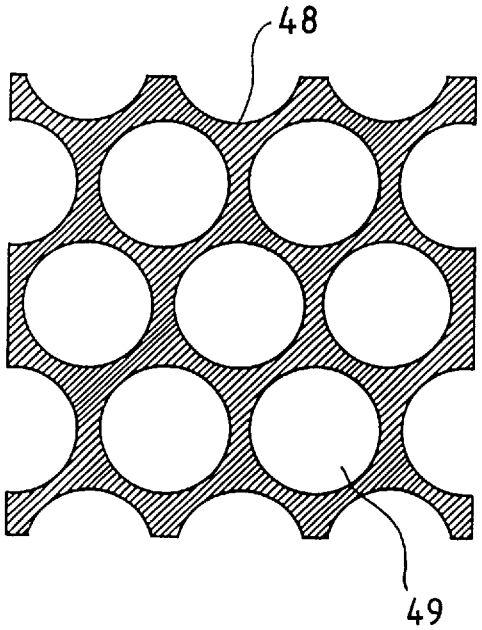
Figure 11:
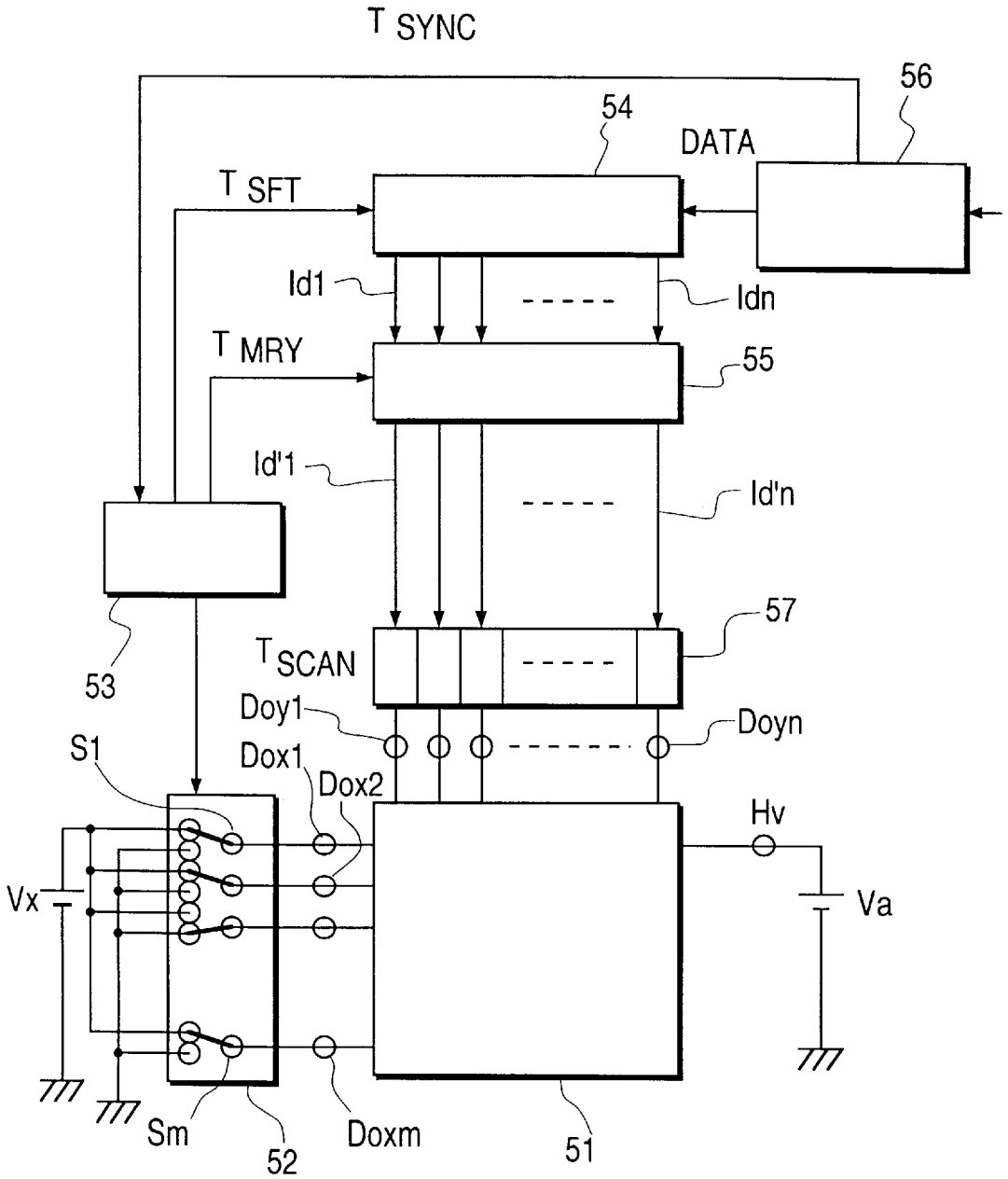
FIG. 11 is a block diagram schematically showing one example of a driving circuit for enabling a display device (panel) using the electron source of matrix wiring type to display TV pictures by TV signals based on NTSC standards.

A description will now be made, with reference to FIGS. 9, 10A, 10B and 11, of an image-forming apparatus constructed by using the above electron source of simple matrix wiring type. FIG. 9 is a schematic perspective view, partly broken, showing one example of a display panel of the image-forming apparatus, FIGS. 10A and 10B are schematic views of fluorescent films for use in the image-forming apparatus of FIG. 9, and FIG. 11 is a block diagram showing one example of a driving circuit adapted to display an image in accordance with TV signals of NTSC standards.

In FIG. 9, denoted by 31 is an electron source substrate on which a number of electron-emitting devices are arrayed, 41 is a rear plate to which the electron source substrate 31 is fixed, 46 is a face plate fabricated by laminating a fluorescent film 44, a metal back 45, etc. on an inner surface of a glass substrate 43, and 42 is a support frame. The rear plate 41 and the face plate 46 are joined to the support frame 42 by using frit glass or the like and baking it in an atmosphere of air or nitrogen gas at a temperature ranging from 400° C. to 500° C. for 10 minutes or more, thereby hermetically sealing the joined portions to make up an envelope 47.

Incidentally, reference numeral 34 represents a surface conduction electron-emitting device including an electron-emitting region as shown in FIGS. 1A and 1B, and 32, 33 represent, respectively, X- and Y-directional wires connected to respective ones of the paired device electrodes of the surface conduction electron-emitting devices.

The envelope 47 is made up by the face plate 46, the support frame 42 and the rear plate 41 as mentioned above. However, since the rear plate 41 is provided for the purpose of mainly reinforcing the strength of the substrate 31, the rear plate 41 as a separate member can be dispensed with if the substrate 31 itself has a sufficient degree of strength. In this case, the support frame 42 may directly be joined to the substrate 31 in a hermetically sealed manner, thereby making up the envelope 47 by the face plate 46, the support frame 42 and the substrate 31. Alternatively, a not-shown support called a spacer may be disposed between the face plate 46 and the rear plate 41 so that the envelope 47 has a sufficient degree of strength against the atmospheric pressure.

FIGS. 10A and 10B schematically show examples of the fluorescent film 44. The fluorescent film 44 can be formed of a fluorescent substance alone for monochrome display. For color display, the fluorescent film 44 is formed by a combination of black conductors 48 and fluorescent substances 49, the black conductors 48 being called black stripes or a black matrix depending on patterns of the fluorescent substances. The purpose of providing the black stripes or black matrix is to form black areas between the fluorescent substances 49 in three primary colors necessary for color display, so that color mixing becomes less conspicuous and a reduction in contrast caused by reflection of exterior light by the fluorescent film 44 is suppressed. The black stripes or the like can be made of not only materials containing graphite as a main ingredient which are usually employed in the art, but also any other materials which are electroconductive and have small transmittance and reflectance to light.

Fluorescent substances can be coated on the glass substrate 43 by precipitation, printing or the like regardless of whether the display image is monochrome or colored. On an inner surface of the fluorescent film 44, the metal back 45 is usually provided. The metal back has functions of increasing the luminance by mirror-reflecting light, that is emitted from the fluorescent substances to the inner side, toward the face plate 36, serving as an electrode to apply a voltage for accelerating electron beams, and protecting the fluorescent substances from being damaged by collisions with negative ions produced in the envelope. The metal back can be fabricated, after forming the fluorescent film, by smoothing the inner surface of the fluorescent film (this step being usually called filming) and then depositing Al thereon by vacuum vapor deposition, for example.

To increase electrical conductivity of the fluorescent film 44, the face plate 46 may include a transparent electrode (not shown) provided on an outer surface of the fluorescent film 44.

Before hermetically sealing off the envelope as explained above, careful alignment must be performed in the case of color display so that the fluorescent substances in respective colors and the electron-emitting devices are precisely positioned corresponding to each other.

At which point in time the forming step, the activating step, etc. are to be performed on the surface conduction electron-emitting devices making up the electron source, is appropriately determined case by case depending on the latent image forming method, the developing method and other conditions.

The image-forming apparatus shown in FIG. 9 is manufactured, by way of example, as follows.

As with the stabilizing step explained above, the envelope 47 is evacuated through an evacuation tube (not shown) by an evacuating apparatus of the type using no oil, such as an ion pump or a sorption pump, while heating it to a proper temperature, to thereby establish an atmosphere at a vacuum degree of about $10^{-5}$ Pa in which an amount of remaining organic materials is sufficiently small. The envelope 47 is then hermetically sealed off. To maintain such a vacuum degree in the sealed envelope 47, the envelope may be subjected to gettering. This process is performed by, immediately before or after sealing off the envelope 47, heating a getter disposed in a predetermined position (not shown) within the envelope 47 by resistance heating or high-frequency heating so as to form a vapor deposition film of the getter. The getter usually contains Ba as a primary component. The pressure of the inner space of the envelope can be maintained at a vacuum degree in the range of $1\times10^{-4}$ to $1\times10^{-5}$ Pa by the adsorbing action of the vapor deposition film. Incidentally, the steps subsequent to the forming treatment of the surface conduction electron-emitting devices can appropriately be set case by case.

One exemplary configuration of a driving circuit. for displaying a TV image in accordance with TV signals of NTSC standards on a display panel constructed by using the electron source of simple matrix wiring type will be described below with reference to FIG. 11. In FIG. 11, 51 is an image display panel, 52 is a scanning circuit, 53 is a control circuit, 54 is a shift register, 55 is a line memory, 56 is a synch signal separating circuit, 57 is a modulation signal generator, and Vx and Va are DC voltage sources.

The display panel 51 is connected to the external electrical circuits through terminals Dox1 to Doxm, terminals Doy1 to Doyn, and a high-voltage terminal Hv. Applied to the terminals Dox1 to Doxm is a scan signal for successively driving the electron source provided in the display panel, i.e., a group of surface conduction electron-emitting devices wired into a matrix of M rows and N columns, on a row-by-row basis (i.e., in units of N devices).

On the other hand, applied to the terminals Doy1 to Doyn is a modulation signal for controlling electron beams output from the surface conduction electron-emitting devices in one row selected by the scan signal. The high-voltage terminal Hv is supplied with a DC voltage of 10 kV, for example, from the DC voltage source Va. This DC voltage serves as an accelerating voltage for giving the electron beams emitted from the surface conduction electron-emitting devices energy enough to excite the corresponding fluorescent substances.

The scanning circuit 52 will now be described. The scanning circuit 52 includes a number M of switching devices (symbolically shown by S1 to Sm in FIG. 11). Each of the switching devices selects an output voltage of the DC voltage source Vx or 0 V (ground level), and is electrically connected to corresponding one of the terminals Dox1 to Doxm of the display panel 51. The switching devices S1 to Sm are operated in accordance with a control signal Tscan output by the control circuit 53, and can easily be made up by a combination of typical switching devices such as FETs.

The DC voltage source Vx outputs a constant voltage set in this embodiment based on characteristics of the surface conduction electron-emitting devices (i.e., electron-emitting threshold voltage) so that the driving voltage applied to the devices not being scanned is kept lower than the electron-emitting threshold voltage.

The control circuit 53 functions to make the various components operated in synch with each other so as to properly display an image in accordance with video signals input from the outside. Thus, in accordance with a synch signal Tsync supplied from the synch signal separating circuit 56, the control circuit 53 generates control signals Tscan, Tsft and Tmry for the associated components.

The synch signal separating circuit 56 is a circuit for separating a synch signal component and a luminance signal component from a TV signal of NTSC standards applied from the outside, and can be made up by using ordinary frequency separators (filters) or the like. The synch signal separated by the synch signal separating circuit 56 comprises a vertical synch signal and a horizontal synch signal, but it is here represented by the signal Tsync for convenience of description. Also, the video luminance signal component separated from the TV signal is represented by a signal DATA for convenience of description. The signal DATA is input to the shift register 54.

The shift register 54 carries out serial/parallel conversion of the signal DATA, which is time-serially input to the register, for each line of an image. The shift register 54 is operated in accordance with the control signal Tsft supplied from the control circuit 53 (hence the control signal Tsft can be said as a shift clock for the shift register 54). Data for one line of the image (corresponding to data for driving the number N of electron-emitting devices) resulting from the serial/parallel conversion is output from the shift register 54 as a number N of parallel signals Idl to Idn.

The line memory 55 is a memory for storing the data for one line of the image for a period of time as long as required. The line memory 55 stores the contents of the parallel signals Id1 to Idn in accordance with the control signal Tmry supplied from the control circuit 53. The stored contents are output as I'd1 to I'dn and applied to the modulation signal generator 57.

The modulation signal generator 57 is a signal source for properly driving the surface conduction electron-emitting devices in accordance with the respective video data I'd1 to I'dn in a modulated manner. Output signals from the modulation signal generator 57 are applied to the corresponding surface conduction electron-emitting devices in the display panel 51 through the terminals Doy1 to Doyn.

As described above, the electron-emitting devices to which the present invention is applicable each have basic characteristics below with regards to the emission current Ie. Specifically, the electron-emitting device has a definite threshold voltage Vth for emission of electrons and emits electrons only when a voltage exceeding Vth is applied. In addition, for the voltage exceeding the electron emission threshold, the emission current is also changed depending on changes in the voltage applied to the device. Therefore, when a pulse-like voltage is applied to the device, no electrons are emitted if the applied voltage is lower than the electron emission threshold value, but an electron beam is produced if the applied voltage exceeds the electron emission threshold value. On this occasion, the intensity of the produced electron beam can be controlled by changing a crest value Vm of the pulse. Further, the total amount of charges of the produced electron beam can be controlled by changing a width Pw of the pulse.

Thus, the electron-emitting device can be modulated in accordance with an input signal by a voltage modulating method, a pulse width modulating method and so on. In the case of employing the voltage modulating method, the modulation signal generator 57 can be realized by using a circuit of voltage modulation type which generates a voltage pulse having a fixed duration and modulates a crest value of the voltage pulse in accordance with input data.

In the case of employing the pulse width modulating method, the modulation signal generator 57 can be realized by using a circuit of pulse width modulation type which generates a voltage pulse having a fixed crest value and modulates a width of the voltage pulse in accordance with input data.

The shift register 54 and the line memory 55 may be designed to be adapted for any of digital signals and analog signals. Anyway, it is essential that the serial/parallel conversion and storage of video signals be effected at a predetermined speed.

For digital signal design, it is required to convert the signal DATA output from the synch signal separating circuit 56 into a digital signal, but this can easily be realized just by incorporating an A/D converter in an output portion of the circuit 56. Further, depending on whether the output signal of the line memory 55 is digital or analog, the circuit used for the modulation signal generator 57 must be designed in somewhat different ways. More specifically, when the voltage modulating method using a digital signal is employed, the modulation signal generator 57 is constituted by, e.g., a D/A converter and, if necessary, may additionally include an amplifier, etc. When the pulse width modulating method using a digital signal is employed, the modulation signal generator 57 is constituted by a circuit in combination of, for example, a high-speed oscillator, a counter for counting the number of waves output from the oscillator, and a comparator for comparing an output value of the counter and an output value of the line memory. In this case, if necessary, an amplifier for amplifying a voltage of the modulation signal, which is output from the comparator and has a modulated pulse width, to the driving voltage for the surface conduction electron-emitting devices may also be added.

On the other hand, when the voltage modulating method using an analog signal is employed, the modulation signal generator 57 can be constituted by an amplifier circuit using, e.g., an operational amplifier and, if necessary, may additionally include a level shift circuit. When the pulse width modulating method using an analog signal is employed, the modulation signal generator 57 can be constituted by a voltage controlled oscillator (VCO), for example. In this case, if necessary, an amplifier for amplifying a voltage of the modulation signal to the driving voltage for the surface conduction electron-emitting devices may also be added.

In the thus-arranged image-forming apparatus to which the present invention is applicable, electrons are emitted from the electron-emitting devices by applying a voltage to them through the terminals Dox1 to Doxm and Doy1 to Doyn extending outwardly of the envelope. The electron beams are accelerated by applying a high voltage to the metal back 45 or the transparent electrode (not shown) through the high-voltage terminal Hv. The accelerated electrons impinge against the fluorescent film 44 which generates fluorescence to form an image.

The above-explained arrangement of the image-forming apparatus is one example of image-forming apparatus to which the present invention is applicable, and can be modified in various ways based on the technical concept of the present invention. The input signal is not limited to an NTSC TV signal mentioned above, but may be any of other TV signals of PAL- and SECAM-standards, including another type of TV signal (e.g., so-called high-quality TV signal of MUSE-standards) having the larger number of scan lines than the above types.

An electron source of ladder wiring type and an image-forming apparatus using such an electron source will now be described with reference to FIGS. 12 and 13.

Figure 12:
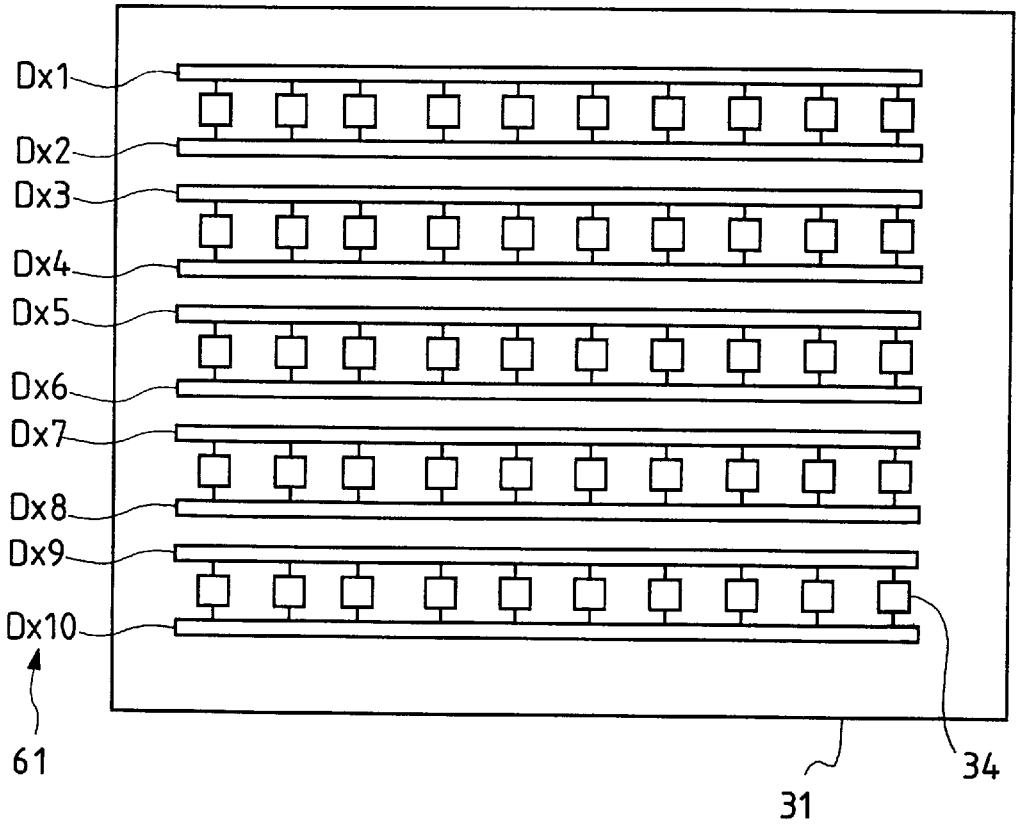
FIG. 12 is a schematic view for explaining the configuration of an electron source of ladder wiring type manufactured according to the present invention.

FIG. 12 is a schematic view showing one example of the electron source of ladder wiring type. In FIG. 12, denoted by 31 is an electron source substrate, 34 is an electron-emitting device, and 61 or Dx1 to Dx10 are common wires for interconnecting the electron-emitting devices 34. A plurality of electron-emitting devices 34 are arrayed on the substrate 31 side by side to line up in the X-direction (a resulting row of the electron-emitting devices being called a device row). This device row is arranged in plural number to make up an electron source. By applying a driving voltage to between the common wires of each device row, respective device rows can be driven independently of one another. Specifically, a voltage exceeding the electron emission threshold value is applied to the device rows from which electron beams are to be emitted, whereas a voltage lower than the electron emission threshold value is applied to the device rows from which electron beams are not to be emitted. Incidentally, those pairs of the common wires Dx2 to Dx9 which are located between two adjacent device rows, e.g., Dx2 and Dx3, may be each formed as a single wire.

Figure 13:
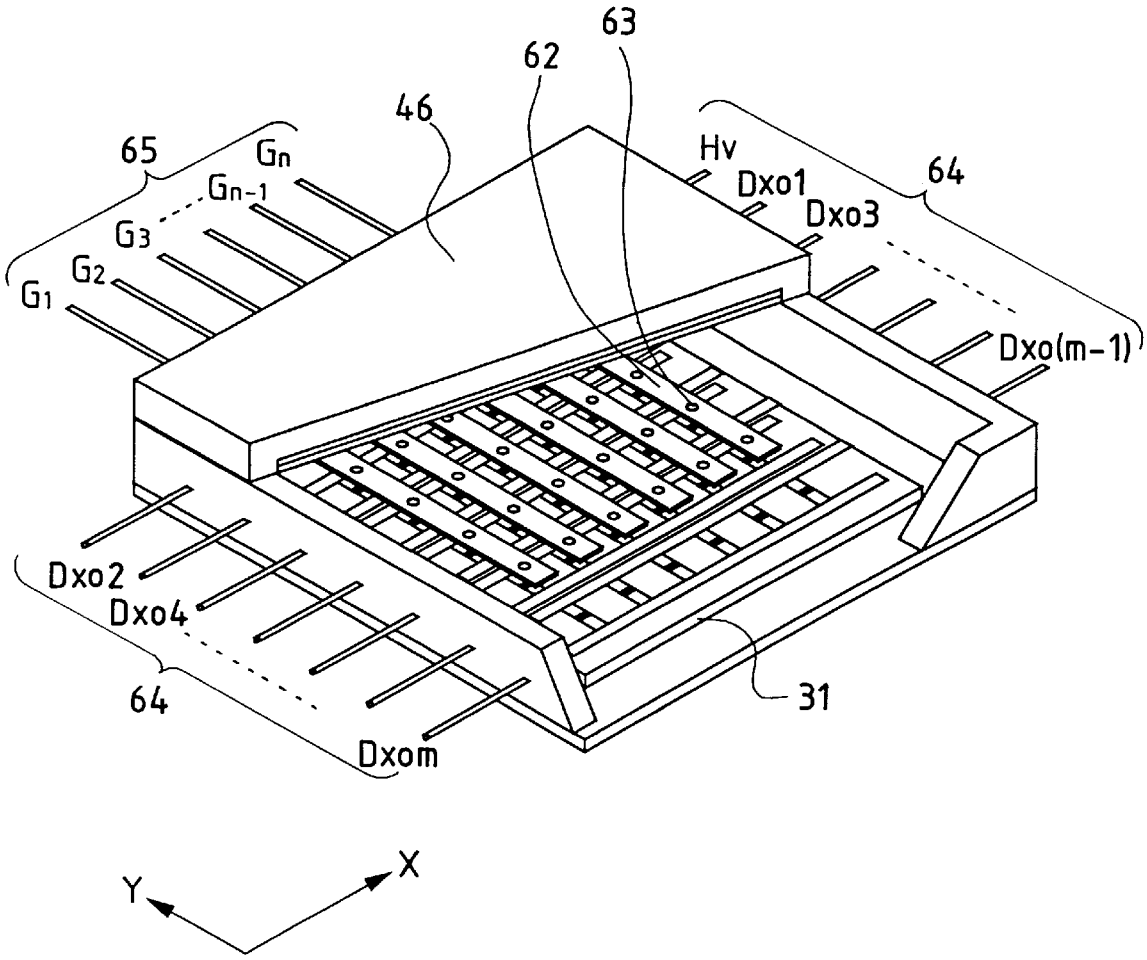
FIG. 13 is a perspective view, partly broken, schematically showing one example of an image-forming apparatus manufactured according to the present invention in which the electron source of matrix wiring type, an image display member, etc. are combined with each other.

FIG. 13 is a schematic view showing one example of the panel structure of the image-forming apparatus including the electron source of ladder wiring type. Denoted by 62 is a grid electrode and 63 is an aperture for allowing electrons to pass therethrough. 64 denotes terminals extending out of the envelope as indicated by Dox1, Dox2, . . . , Doxm, 65 denotes terminals extending out of the envelope as indicated by G1, G2, . . . , Gn and connected to the corresponding grid electrodes 62, and 31 denotes an electron source substrate in which the common wires located between two adjacent device rows may be each formed as a single wire. The image-forming apparatus shown in FIG. 13 is different from the image-forming apparatus of simple matrix wiring type shown in FIG. 9 mainly in that the grid electrodes 62 are interposed between the electron source substrate 31 and the face plate 46.

The image-forming apparatus shown in FIG. 13 includes the grid electrodes 62 interposed between the electron source substrate 31 and the face plate 46. The grid electrodes 62 serve to modulate electron beams emitted from the surface conduction electron-emitting devices. The grid electrodes 62 are stripe-shaped electrodes extending perpendicularly to the device rows in the ladder wiring, and have circular apertures 63 formed therein for passage of the electron beams in one-to-one relation to the electron-emitting devices. The shape and set position of the grid electrodes are not necessarily limited to ones illustrated in FIG. 13. For example, the apertures may be a large number of mesh-like small openings, or may be positioned around or in the vicinity of the surface conduction electron-emitting devices.

The external terminals 64 and the external grid terminals 65 both extending out of the envelope are electrically connected to a control circuit (not shown).

In the image-forming apparatus of this embodiment, modulation signals for one line of the image are simultaneously applied to each row of the grid electrode in synch with the device rows being driven (scanned) successively on a row-by-row basis. As a result, irradiation of the electron beams upon the fluorescent substances can be controlled so as to display an image on a line-by-line basis.

The image-forming apparatus of the present invention can be employed as not only a display for TV broadcasting, but also displays for TV conference systems, computers, etc., including an image-forming apparatus for an optical printer made up by a photosensitive drum and so on.

[Example 1]

Figure 14A:
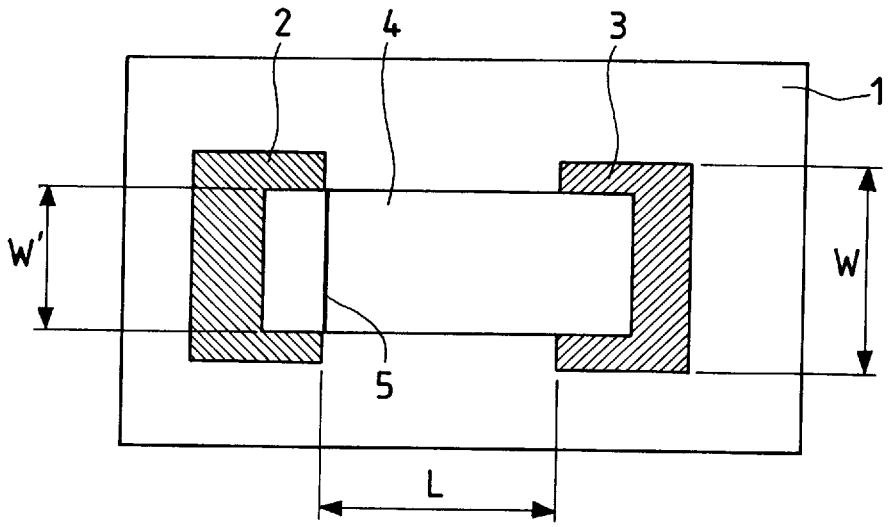
FIGS. 14A and 14B are schematic views showing the structure of a surface conduction electron-emitting device manufactured by a method of Example 1 of the present invention.
Figure 14B:
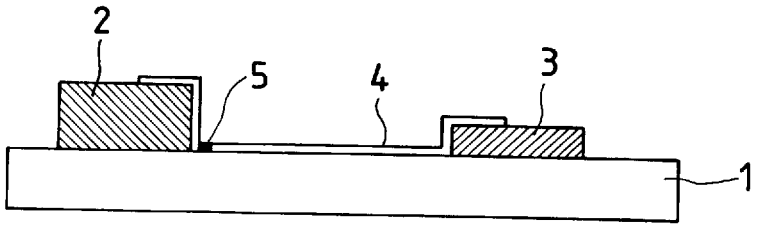

FIGS. 14A and 14B schematically show the structure of a surface conduction electron-emitting device manufactured by a method of this Example 1.

Figure 15A:
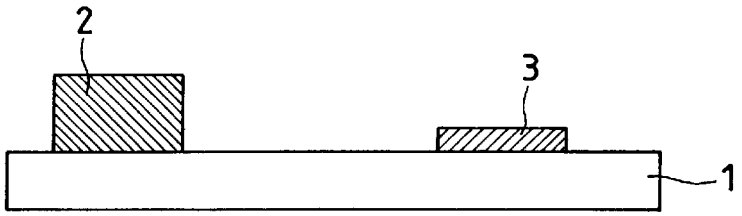
FIGS. 15A to 15C are schematic views for explaining a manufacture process of Embodiment 1.

The manufacturing process of this Example will be described below with reference to FIGS. 15A to 15C.

While the structure of one device is shown in the figures for the sake of simplicity, four identical devices were fabricated on a single substrate in this Example.

Step-a

The substrate 1 was prepared by cleaning a quartz glass with a detergent, pure water and an organic solvent. Then, Pt as a device electrode material was deposited in a thickness of 30 nm by sputtering using a mask which had openings corresponding to a pattern of the device electrodes. Then, after closing only one opening corresponding to one of the device electrodes, Pt was further deposited in a thickness of 80 nm. The device electrode 2 being 110 nm thick and the device electrode 3 being 30 nm thick were thereby formed (See FIG. 15A).

Incidentally, the spacing between the device electrodes was set to L=100 $\mu$m.

Step-b

A Cr film being 100 nm thick was formed by vacuum evaporation on the substrate having the device electrodes formed thereon. The Cr film was then patterned by photolithography to define an opening corresponding to the shape of the electro-conductive thin film. A width of the opening was set to 100 $\mu$m.

Then, a Pd amine complex solution (ccp4230, by Okuno Pharmaceutical Co., Ltd.) was coated on the substrate under rotation by using a spinner, followed by heating for calcination in open air at 300° C. for 10 minutes. A film made up primarily of PdO fine particles was thereby formed. This film had a thickness of about 10 nm.

Figure 15B:
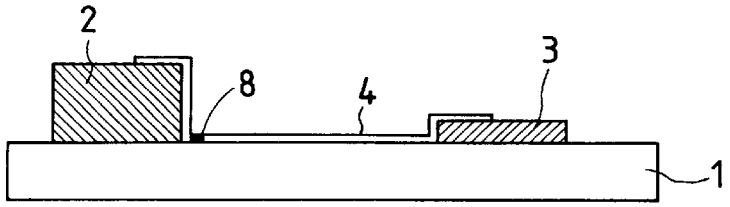
Figure 15C:
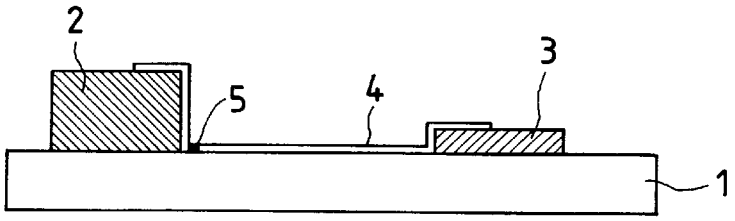

After that, the Cr film was removed by wet etching to form the electro-conductive thin film 4 in a desired pattern by lift-off (See FIG. 15B). The electro-conductive thin film 4 had a resistance value Rs=$5\times10^4$ Ω/□.

The device in this stage was observed by using a field emission type scanned electronic microscope (FESEM). As a result, it was confirmed that a portion which had a thinner film than the other portion and was apparently different in dispersed condition of fine particles from the other portion, i.e., the structural latent image 8, was formed along a lower edge of the step defined by the device electrode 2, i.e., the boundary between the device electrode 2 and the substrate 1.

Step-c

The thus-obtained device was subjected to heat treatment in open air at 400° C. for 30 minutes by using a heat treating furnace. The structural latent image 8 was thereby changed into the electron-emitting region 5 having high resistance (See FIG. 15C).

Step-d

The device obtained by the above step was set in the vacuum treatment apparatus shown in FIG. 6, and the vacuum vessel 16 was evacuated by the evacuating apparatus 17 until reaching a pressure of about $1.3\times10^{-3}$ Pa. The evacuating apparatus used in this Example was a high vacuum evacuation system comprising a turbo pump and a rotary pump. Subsequently, the activating step was performed by applying rectangular wave pulses to the device. The pulse width was T1=1 msec, the pulse interval was T2=10 msec, and the crest value was Vact=15 V.

After the activating step, the pressure was further reduced to about $1.3\times10^{-4}$ Pa and the device current If and the emission current Ie were measured by applying similar pulses as used in the activating step. However, the crest value was set to 14 V. The spacing between the anode electrode 15 and the device was H=5 mm and the potential difference was 1 kV.

[Comparative Example 1]

Step-a

The substrate 1 was prepared by cleaning a quartz glass with a detergent, pure water and an organic solvent. Then, Pt as a device electrode material was deposited in a thickness of 30 nm by sputtering using a mask which had openings corresponding to the pattern of the device electrodes, thereby forming the device electrodes.

Incidentally, the spacing between the device electrodes was set to L=100 $\mu$m.

Step-b

The electro-conductive thin film was formed in the same manner as in Example 1.

Step-c

The device was set in the vacuum treatment apparatus shown in FIG. 6 and, after evacuating the vacuum vessel 16, it was heated for reducing PdO in the electro-conductive thin film to Pd. Then, triangular wave pulses were applied to between the device electrodes to carry out the energization forming, thereby forming the electron-emitting region.

Step-d

The activating step was carried out in the same manner as in Example 1.

Step-e

The stabilizing step was carried out in the same manner as in Example 1.

After that, characteristics of electron emission were measured on the same conditions as in Example 1. Results of If and Ie measured under respective four devices of Example 1 and Comparative Example 1 are below.

| | If (mA) | | Ie ($\mu$A) | |
|---|---|---|---|---|
| | Average value | Variations (%) | Average value | Variations (%) |
| Example 1 | 0.95 | 5.0 | 0.95 | 4.5 |
| Com. Ex. 1 | 1.0 | 25 | 0.9 | 30 |

At the same time, a fluorescent film was placed on the anode electrode 15 and the shape of each bright spot on the fluorescent film produced by an electron beam emitted from the electron-emitting device was measured. As a result, the bright spot produced by the device of Example 1 was 35 $\mu$m smaller than that produced by the device of Comparative Example 1.

Also, the shape of the electron-emitting region was observed by using an FESEM. Results are schematically shown in FIGS. 16A and 16B (as mentioned before, four devices were actually formed on one substrate).

Figure 16A:
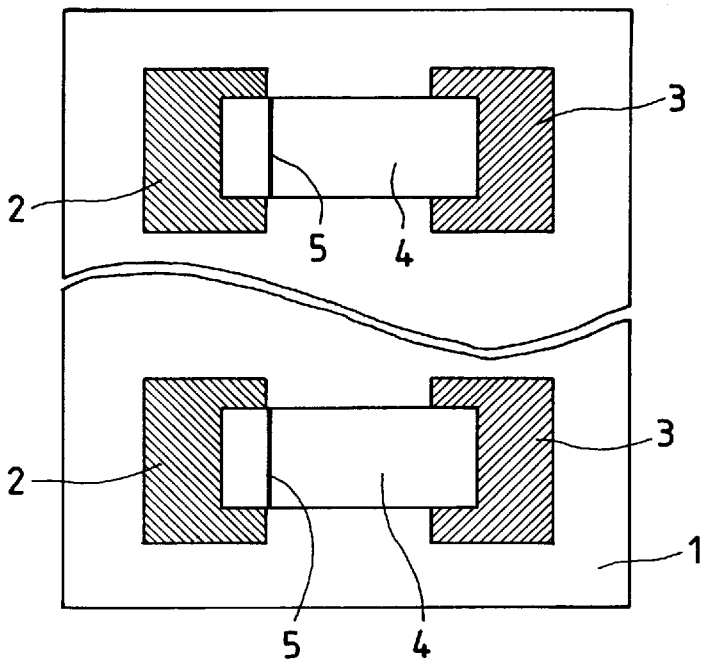
FIGS. 16A and 16B are schematic views showing results of observing the shapes of electron-emitting regions of electron-emitting devices, which are manufactured by Example 1 and Comparative Example 1, by using a field emission type scanned electronic microscope (FESEM).
Figure 16B:
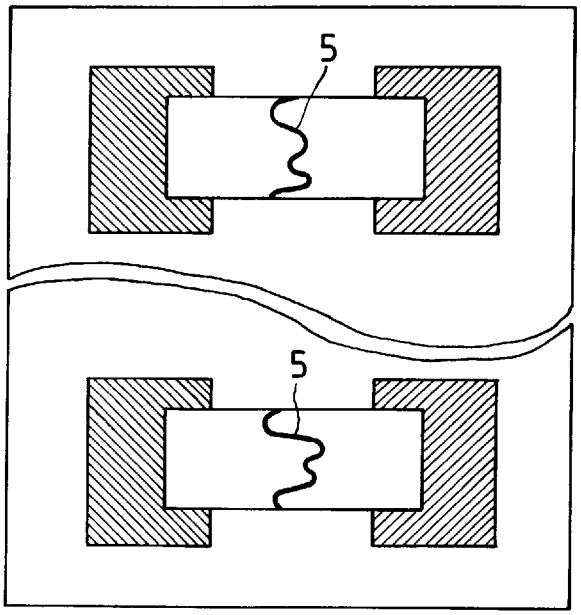

In any of the four devices of Example 1, as shown in FIG. 16A, the electron-emitting region being remarkably changed in the microstructure was formed in a portion of the electro-conductive thin film including the structural latent image formed near the device electrode 2. On the other hand, as shown in FIG. 16B, the electron-emitting region in each device of Comparative Example 1 was formed near the center between the device electrodes 2 and 3 while extending in a zigzag direction with a width of about 50 $\mu$m.

[Example 2]

Figure 17A:
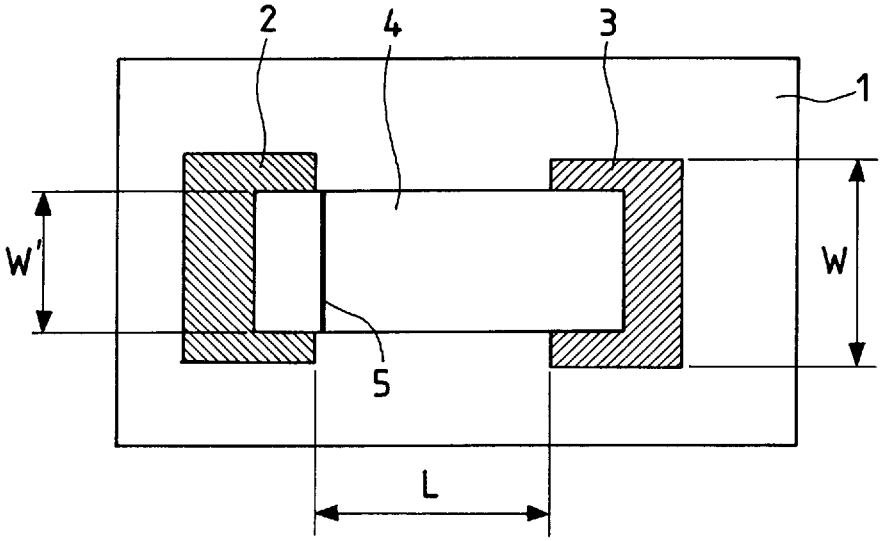
FIGS. 17A and 17B are schematic views showing the structure of a surface conduction electron-emitting device manufactured by a method of Example 2 of the present invention.
Figure 17B:
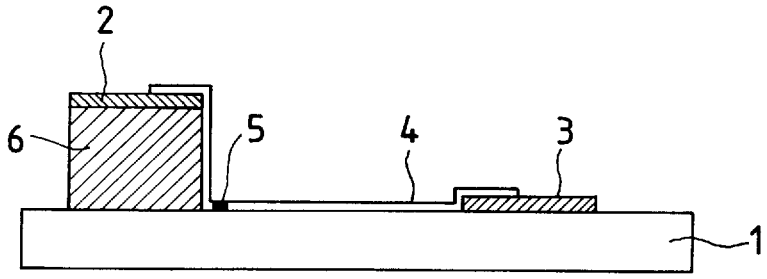

FIGS. 17A and 17B schematically show the structure of a surface conduction electron-emitting device manufactured by a method of this Example 2.

While the structure of one device is shown in the figures for the sake of simplicity, four identical devices were fabricated on a single substrate in this Example.

Step-a

The substrate 1 was prepared by cleaning a quartz glass with a detergent, pure water and an organic solvent. Then, a SiOx film was deposited in a thickness of 150 nm by sputtering, and after coating a resist was thereon, it was patterned to form a mask covering the shape of one of the device electrodes (i.e., the device electrode 2) was formed.

The SiOx film except the masked area was removed by reactive ion etching (RIE) and the remaining resist pattern was also removed, thereby forming the height restricting member 6 made of SiOx. Then, as with Example 1, Pt was deposited in a thickness of 30 nm by sputtering using a mask to form the device electrodes 2, 3. Incidentally, the spacing between the device electrodes was set to 50 $\mu$m.

Step-b

A Cr film being 100 nm thick was formed by vacuum evaporation on the substrate having the device electrodes formed thereon, and then patterned to define an opening corresponding to the shape of the electro-conductive thin film as with Example 1. A width of the opening was set to 100 $\mu$m.

Subsequently, a Pd film was deposited in a thickness of 100 nm by vacuum evaporation and, thereafter, the Cr film was removed by wet etching to form the electro-conductive thin film 4 in a desired pattern by lift-off patterning of the Pd film. The electro-conductive thin film 4 had a resistance value Rs=$3.8\times10^{2}$ Ω/□.

In this stage, the structural latent image 6 was formed in a portion of the electro-conductive thin film 4 in contact with the height restricting member 6 due to such an effect of the step defined by the height restricting member 6 as impeding formation of the Pd film in a foot portion of the step.

Step-c

The thus-obtained device was set in the vacuum treatment apparatus shown in FIG. 6, and the vacuum vessel 16 was evacuated until reaching a pressure of about $1.3\times10^{-3}$ Pa. After heating the sample holder 21 and holding it at 300° C. for 30 minutes, the heating was stopped and the device was gradually cooled down to the room temperature. As a result of the above treatment, the structural latent image 8 was developed and the electron-emitting region 5 was formed.

Step-d

The activating step was performed by applying rectangular wave pulses to the device. The pulse width was T1=1 msec, the pulse interval was T2=10 msec, and the crest value was Vact=15 V.

Then, the vacuum vessel 16 was further evacuated to establish a pressure of $1.3\times10^{-4}$ Pa and characteristics of electron emission were measured. The voltage applied to the device was 15 V in the form of rectangular wave pulses, the spacing between the anode electrode 15 and the device was H=5 mm, and the potential difference was 1 kV.

[Comparative Example 2]

Step-a

As with Example 2, the device electrodes 2, 3 made of Pt were formed on the cleaned quartz substrate 1 in a thickness of 30 nm by sputtering using a mask. The spacing between the device electrodes was set to 2 $\mu$m.

Step-b

As with Example 2, a Cr film being 100 nm thick was formed by vacuum evaporation on the substrate having the device electrodes formed thereon, and then patterned to define an opening corresponding to the shape of the electro-conductive thin film. A width of the opening was set to 100 μm.

Subsequently, a Pd film was deposited in a thickness of about 3 nm by sputtering and, thereafter, the Cr film was removed by wet etching to form the electro-conductive thin film 4 in a desired pattern by lift-off patterning of the Pd film.

Step-c

The device was set in the vacuum vessel 16 of the vacuum treatment apparatus and the vacuum vessel 16 was evacuated until reaching $1.3\times10^{-3}$ Pa. Subsequently, as with Comparative Example 1, triangular wave pulses were applied to carry out the energization forming, thereby forming the electron-emitting region 5.

Step-d

The activating step was carried out in the same manner as in the step-d in Example 2.

After that, characteristics of electron emission were evaluated under the same conditions as in Example 2. Results of the evaluation are below.

| | If (mA) | | Ie (μA) | |
|---|---|---|---|---|
| | Average value | Variations (%) | Average value | Variations (%) |
| Example 2 | 0.98 | 4.5 | 0.94 | 5.0 |
| Com. Ex. 2 | 0.95 | 5.0 | 1.02 | 5.0 |

At the same time, a fluorescent film was placed on the anode electrode 15 and the shape of each bright spot on the fluorescent film produced by an electron beam emitted from the electron-emitting device was measured. As a result, the bright spots having nearly equal sizes were observed.

Also, the shape of the electron-emitting region was observed by using an SEM. As a result, it was confirmed that in any of the four devices of Example 2, the electron-emitting region 5 being substantially rectilinear was formed in the vicinity of the device electrode 2 having a higher step, and in each of the four devices of Comparative Example 2, the electron-emitting region 5 being substantially rectilinear like that in Example 2 was formed near the center between the device electrodes.

From the above comparison, it is concluded that by forming the electron-emitting region according to the method of the present invention, the shape of the electron-emitting region and uniformity in characteristics thereof which are achieved by the prior art method with the spacing between the device electrodes set to 2 μm are obtainable even with the spacing between the device electrodes set to 50 μm.

[Example 3]

In this Example, a step is formed between the device electrodes by using the structural latent image forming means similarly to the structure of the surface conduction electron-emitting device shown in FIGS. 2A and 2B.

Figure 18A:
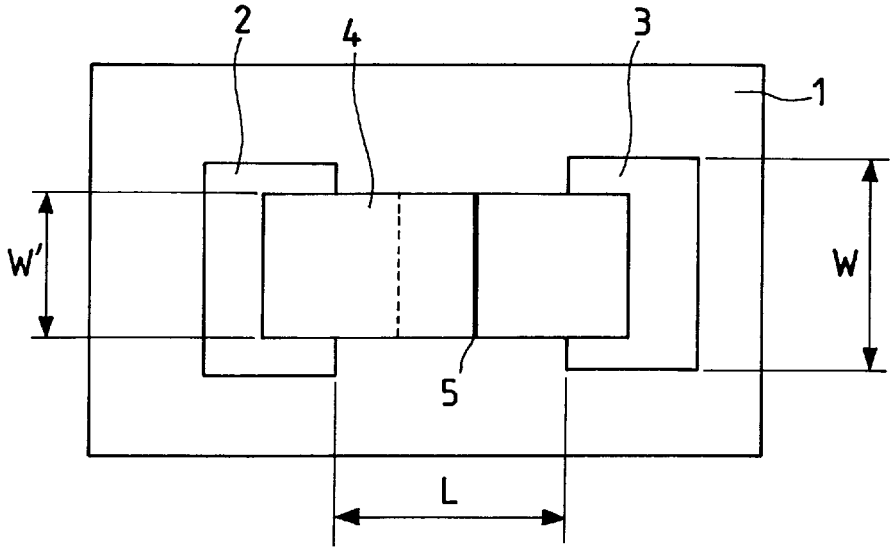
FIGS. 18A and 18B are schematic views showing the structure of a surface conduction electron-emitting device manufactured by a method of Example 3 of the present invention.
Figure 18B:
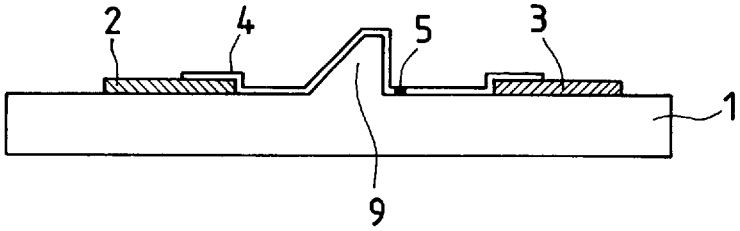

The manufacture process of this Example will be described below with reference to FIGS. 18A to 18B.

Step-a

The substrate 1 was prepared by cleaning a quartz glass with a detergent, pure water and an organic solvent. The step forming member 9 serving as the structural latent image forming image was then formed by RIE. Subsequently, Pt was deposited in a thickness of 40 nm by sputtering using a mask to form the device electrodes. The spacing between the device electrodes was set to 150 μm (See FIG. 18A).

Step-b

A Cr film being 100 nm thick was formed by vacuum evaporation on the substrate having the device electrodes formed thereon, and then patterned to define an opening corresponding to the shape of the electro-conductive thin film.

Then, a Pd amine complex solution (ccp4230, by Okuno Pharmaceutical Co., Ltd.) was coated on the substrate under rotation by using a spinner, followed by heating for calcination in open air at 300° C. for 10 minutes. A film made up primarily of PdO fine particles was thereby formed. This film had a thickness of about 6 nm.

After that, the Cr film was removed by wet etching to form the electro-conductive thin film 4 in a desired pattern by lift-off patterning of the PdO fine particle film. The electro-conductive thin film 4 had a resistance value $Rs=2.8\times10^{4}$ Ω/□.

As a result of observing the device in this stage by using an FESEM, it was confirmed that a portion which had a thinner film than the other portion and was apparently different in dispersed condition of fine particles from the other portion, i.e., the structural latent image 8, was formed along a lower edge of the step forming member 9 in contact with the substrate on the same side as the device electrode 3.

Step-c

The thus-obtained device was subjected to heat treatment in open air at 400° C. for 30 minutes by using a heat treating furnace. Thereby, the structural latent image 8 was developed and the electron-emitting region 5 was formed.

Step-d

The device obtained by the above step was set in the vacuum treatment apparatus shown in FIG. 6, and the activating step was performed by applying similar pulses as in Example 1. At this time, the pressure in the vacuum vessel 16 was $2.0\times10^{-3}$ Pa.

Then, the pressure in the vacuum vessel 16 was further reduced to $1.3\times10^{-4}$ Pa and characteristics of electron emission were measured. The voltage applied to the device was 14 V in the form of rectangular wave pulses, the spacing between the anode electrode 15 and the device was H=5 mm, and the potential difference was 1 kV.

[Comparative Example 3]

Step-a

As with Comparative Example 1, the substrate 1 was prepared by cleaning a quartz glass. Then, the device electrodes 2, 3 made of Pt were formed in a thickness of 40 nm by sputtering using a mask. The spacing between the device electrodes was set to 150 μm.

Step-b

As with Example 3, the electro-conductive thin film 4 comprising a film of PdO fine particles was formed in a desired pattern by forming and patterning a Cr film, coating a Pd amine complex solution and heating it for calcination, and removing the Cr film by wet etching.

Step-c

As with Comparative Example 1, the electron-emitting region 5 was formed by carrying out the energization forming.

Step-d

The activating step was carried out in the same manner as in Example 3.

After that, characteristics of electron emission were measured under the same conditions as in Example 3. Results of the measurement are below.

| | If (mA) | | Ie (μA) | |
|---|---|---|---|---|
| | Average value | Variations (%) | Average value | Variations (%) |
| Example 3 | 0.97 | 4.5 | 0.97 | 4.5 |
| Com. Ex. 3 | 1.0 | 25 | 0.9 | 30 |

Figure 19A:
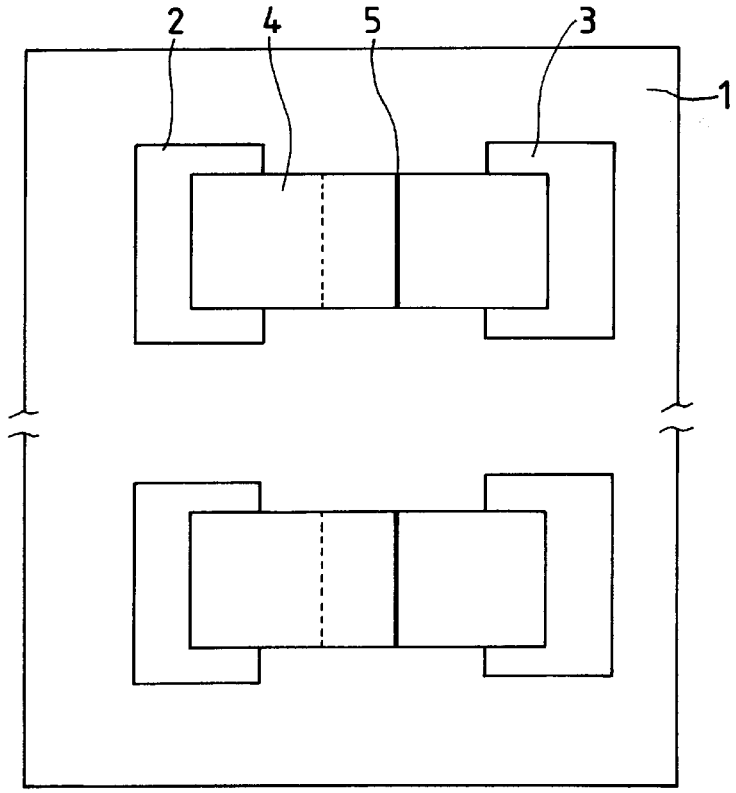
FIGS. 19A and 19B are schematic views showing results of observing the shapes of electron-emitting regions of electron-emitting devices, which are manufactured by Example 3 and Comparative Example 3, by using a field emission type scanned electronic microscope (FESEM).
Figure 19B:
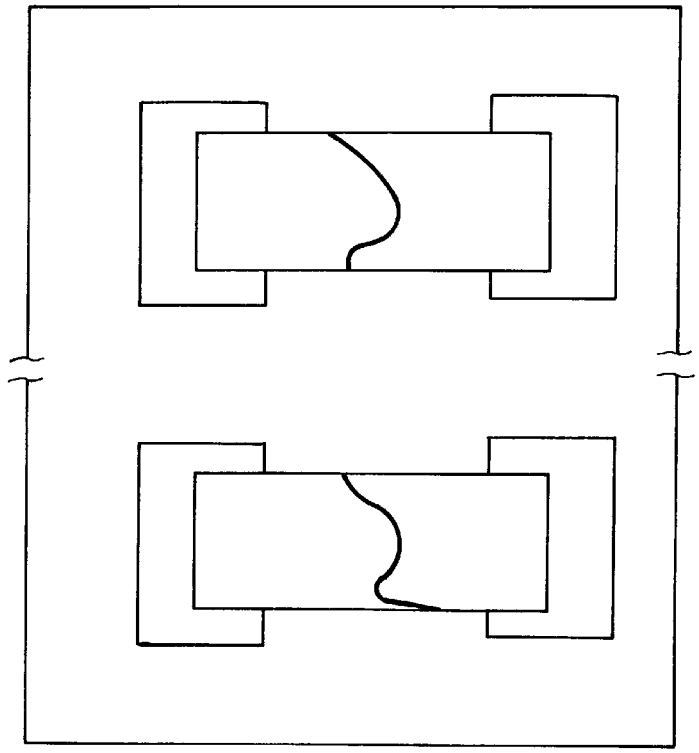

After that, the shape of the electron-emitting region was observed by using an FESEM. Results are schematically shown in FIGS. 19A and 19B. In any of the four devices of this Example 3, the electron-emitting region 5 being substantially changed in the microstructure of fine particles was formed in a portion where the structural latent image 8 had been formed adjacent to one end of the step forming member 9. A thin broken line indicates the other end of the step forming member 9. On the other hand, the electron-emitting region in each device of Comparative Example 3 was formed near the center between the device electrodes while extending in a zigzag direction with a width of about 65 μm.

[Example 4]

Step-a

The substrate 1 was prepared by forming a silicon oxide film in a thickness of 0.5 μm on a cleaned soda lime glass by sputtering. A negative pattern for the first device electrode 3 was formed on the substrate 1 by using a photoresist (RD-2000N-41, by Hitachi Chemical Co., Ltd.). A Ti film being 5 nm thick and an Ni film being 50 nm thick were deposited thereon in this order by vacuum vapor deposition. The photoresist pattern was dissolved by an organic solvent to form the first device electrode 3 by lift-off patterning of the deposited Ni/Ti films.

Likewise, a negative pattern for the second device electrode 2 was formed by using a photoresist. A Cr film being 5 nm thick and an Au film being 50 nm thick were deposited thereon in this order by vacuum evaporation. The second device electrode 2 was then formed by lift-off patterning of the deposited Au/Cr films.

The spacing L between the device electrodes was set to L=30 μm and the length of each device electrode was set to W=300 μm.

Step-b

A Cr film being 100 nm thick was deposited by vacuum evaporation on the substrate, and then patterned in a similar manner as in the above step to define an opening corresponding to the shape of the electro-conductive thin film, thereby forming a Cr mask. Then, a Pd amine complex solution (ccp4230, by Okuno Pharmaceutical Co., Ltd.) was coated thereon under rotation by using a spinner, followed by heating for calcination in open air at 300° C. for 10 minutes. A film made up of PdO fine particles was thereby formed. After that, the Cr mask was removed by wet etching to form the electro-conductive thin film 4 in a desired pattern by lift-off patterning of the PdO film.

The electro-conductive thin film 4 made of PdO had a thickness of about 10 nm and a resistance value Rs=$2\times10^4$ Ω/□.

Step-c

The thus-obtained device was set in the vacuum vessel 16 of the vacuum treatment apparatus shown in FIG. 6, and the vacuum vessel 16 was evacuated by the evacuating apparatus 17 until reaching a pressure of $1.3\times10^{-3}$ Pa. After heating the device by a heater (not shown) built in the sample holder 21 and holding it at 450° C. for 1 hour, the heater was turned off and the device was gradually cooled down to the room temperature.

Before the heat treatment, the device resistance was about 1 kΩ. At 250° C. in the course of temperature rise under heating, there occurred an abrupt change down to low resistance. This is presumably caused by reduction of PdO to Pd. After that, the device resistance changed complexly as the temperature further rose, and showed 200 Ω when returned to the room temperature. It is thought that such a complex behavior of the device resistance is attributable to changes in the film form caused by aggregation of the fine particles making up the electro-conductive thin film, and formation of fissures along an edge of the second device electrode 2 (Au electrode).

To more positively form the electron-emitting region, a voltage was applied to the device in the vacuum vessel 16.

In this Example, rectangular wave pulses were applied with the pulse width set to T1=1 msec and the pulse interval set to T2=10 msec. The pulse crest value was raised in steps of 0.1 V at a rate of 0.2 V/min. Simultaneously, measurement pulses of 0.1 V were each inserted between two forming pulses to measure a value of the device resistance. Thus, the forming treatment was carried out while measuring the resistance value, and application of the pulses was stopped when the resistance value exceeded 1 MΩ. The crest value at the end of application of the pulses was 1.0 V and a maximum value of If immediately before an abrupt rise of the resistance value was 5 mA.

Step-d

Subsequently, the activating step was carried out in the vacuum vessel 16. Rectangular pulses having the same pulse width and interval as in the above step were applied to the device with the crest value set to 14 V. A voltage was applied on condition that the second device electrode 2 (Au electrode) was set as a negative pole. The pressure in the vacuum vessel at this time was $1.3\times10^{-3}$ Pa. This activating step was performed while measuring the device current If and the emission current Ie. The spacing between the anode electrode 15 and the device was H=4 mm, and the potential difference was 1 kV. The emission current Ie was almost saturated in 30 minutes, and hence the activating step was finished there.

[Comparative Example 4]

Step-a and Step-b were performed in the same manner as in Example 4.

Step-c

The forming treatment was carried out by applying a voltage to the device in the vacuum vessel 16.

In this Comparative Example, rectangular wave pulses were applied with the pulse width set to T1=1 msec and the pulse interval set to T2=10 msec. The pulse crest value was raised in steps of 0.1 V at a rate of 0.2 V/min. Simultaneously, measurement pulses of 0 1 V were each inserted between two forming pulses to measure a resistance value of the device. Thus, the forming treatment was carried out while measuring the resistance value, and application of the pulses was stopped when the resistance value exceeded 1 MΩ. The crest value at the end of application of the pulses was 5.0 V and a maximum value of If immediately before an abrupt rise of the resistance value was 25 mA.

Step-d

The stabilizing step was carried out in the same manner as in Example 4.

The surface conduction electron-emitting devices of Example 4 and Comparative Example 4 were manufactured ten times through the steps described above. Characteristics of each of the manufactured devices were measured by using the vacuum treatment apparatus.

As a result of applying triangular wave pulses with T1=100 μsec and T2=10 msec and measuring current versus voltage characteristics, stable MI characteristics as shown in FIG. 7 were obtained. Then, Ie and If were measured by applying rectangular pulses having of 14 V with T1 and T2 having the same values as above. Results of the measurement are below.

| | If (mA) | | Ie (1A) | |
|---|---|---|---|---|
| | Average value | Variations (%) | Average value | Variations (%) |
| Example 4 | 2.0 | 6.5 | 1.0 | 5.0 |
| Com. Ex. 4 | 2.0 | 25 | 1.0 | 10.0 |

After the measurement of characteristics, the devices manufactured by Example 4 were each observed by using a scanned electron microscope (SEM). As a result, it was confirmed that the electron-emitting region 5 was formed rectilinearly along an edge of the second device electrode 2 (Au electrode), and a coating was formed on the electro-conductive thin film in the positive pole side of the electron-emitting region. As a result of observing the device by using a field emission type scanned electron microscope (FESEM) with higher resolution, it was confirmed that the coating was also formed around and between the Pd fine particles making up the electro-conductive thin film. The coating was measured by using a transmission electron microscope (TEM) and a Raman photospectrometer. From measured results, it is estimated that the coating contains carbon as a primary component, and consists of graphite in some part and amorphous carbon, etc. in other part.

On the other hand, the electron-emitting region in each device of Comparative Example 4 was formed while zig-zagging to a large extent with a width of about 20 μm.

According to the method of this Example, as described above, even when the spacing between the device electrodes is relatively wide, on the order of 30 μm, the position and shape of the electron-emitting device can be well controlled and uniformity in characteristics of electron emission can be improved.

[Example 5]

Step-a

The substrate 1 was prepared by forming a silicon oxide film in a thickness of 0.5 μm on a cleaned soda lime glass by sputtering. A Ti film being 5 nm thick and a Pt film being 50 nm thick were deposited thereon in this order by vacuum vapor deposition, and then patterned by ordinary photolithography to form the device electrodes 2, 3. The spacing between the device electrodes was set to L=30 μm as with Example 4.

Subsequently, Au was deposited on the device electrode 3 by electrolytic plating to form an Au coating with a thickness of 0.1 μm.

Step-b

As with Example 4, a film of PdO fine particles formed by coating and calcinating a Pd amine complex solution while using a mask of a Cr film was patterned by lift-off, thereby forming the electro-conductive thin film 4.

Step-c

The thus-obtained device was set in a heat treatment furnace in which heat treatment was carried out at 300° C. for 20 minutes in stream of a gas mixture of 98% $N_2$ —2% $H_2$ at 1 atm. With this heat treatment, the electro-conductive thin film was reduced for conversion into a film of Pd fine particles and the electron-emitting region was formed in a portion of the film in contact with the device electrode 3. This is presumably resulting from an alloying reaction between Au and Pd, causing Pd atoms to be more strongly aggregated by diffusion than the other portion and to move toward the device electrode.

Step-d

The activating step was carried out in the same manner as in Example 4.

The surface conduction electron-emitting device of this Example 5 was manufactured ten times through the steps described above. As a result of measuring current versus voltage characteristics of each of the manufactured devices in the same manner as in Example 4, similar characteristics as in Example 4 were obtained. It was also confirmed that variations in Ie measured by applying pulses of 14 V were held within 5% and a similar advantage as in Example 4 was achieved.

As a result of observing the shape of the electron-emitting region by using an SEM, it was confirmed that the electron-emitting region was formed rectilinearly along an edge of the device electrode 3 as with Example 4.

[Example 6]

As with Step-a and Step-b in Example 5, the device electrodes 2, 3 and the electro-conductive thin film 4 were formed on the substrate 1.

Step-c

The thus-obtained device was set in the vacuum treatment apparatus, and hydrogen gas was introduced to the vacuum vessel 16 after evacuating it.

When a constant voltage of 0.5 V was applied to the device and this condition was held for 10 minutes, the device resistance exceeded 1 MΩ and, at this point in time, application of the voltage was stopped. This high resistance presumably results from the forming treatment being carried out with the Joule heat generated upon application of the voltage as with Examples 4 and 5.

Step-d

The stabilizing step was carried out after further evacuating the vacuum vessel 16 in the same manner as in Example 4.

Characteristics of the manufactured device were measured with the device voltage set to 16 V. As with Examples 4 and 5, the surface conduction electron-emitting device of this Example 6 was manufactured ten times and variations in characteristics were measured. Results of the measurement are below.

| | If (mA) | | Ie (μA) | |
|---|---|---|---|---|
| | Average value | Variations (%) | Average value | Variations (%) |
| Example 6 | 2.0 | 6.0 | 1.5 | 5.0 |

The shape of the electron-emitting region of each device was observed by using an SEM. As a result, it was confirmed that the electron-emitting region was formed rectilinearly along an edge of the device. electrode 3 as with Examples 4, 5.

[Example 7]

Figure 20A:
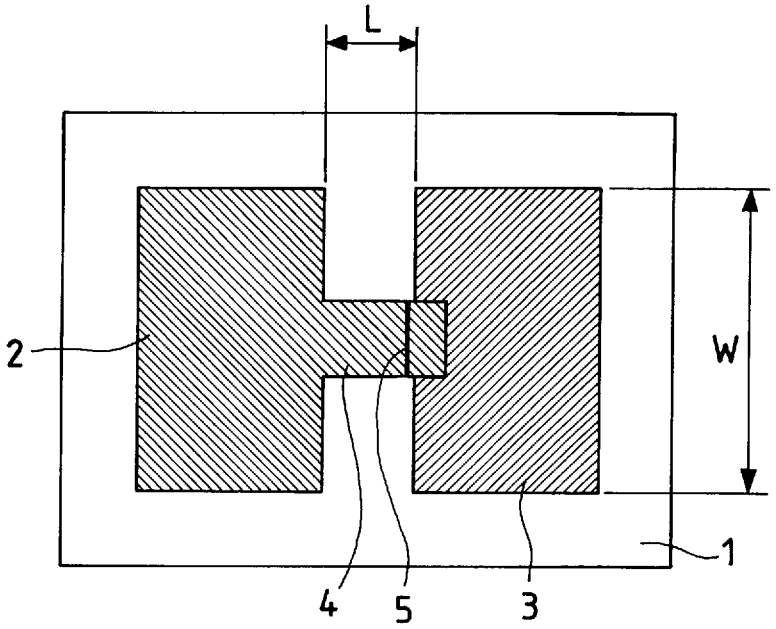
FIGS. 20A and 20B are schematic views for explaining the structure of a surface conduction electron-emitting device manufactured by a method of Example 7 of the present invention.
Figure 20B:
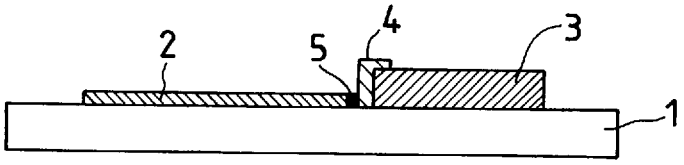

A surface conduction electron-emitting device manufactured by this Example 7 is structured, as shown in FIGS. 20A and 20B, such that one of device electrodes is formed integrally with an electro-conductive film.

Step-a

A cleaned soda lime glass was prepared as the substrate 1. A Cr film being 5 nm thick and an Au film being 50 nm thick were deposited thereon in this order by vacuum evaporation, and then patterned by ordinary photolithography to form the device electrode 3.

Step-b

A resist was coated and patterned to define openings corresponding to a pattern of the device electrode 2 and the electro-conductive thin film 4. A Ti film being 5 nm thick and a Pt film being 30 nm thick were deposited thereon in this order by vacuum evaporation to form the device electrode 2 and the electro-conductive thin film 4 in a unitary structure by lift-off. The spacing between the device electrodes was set to L=30 μm.

Step-c

Heat treatment was carried out in a heat treatment furnace at 600° C. for 1 hour in stream of $N_2$. With this heat treatment, the electron-emitting region 5 was formed along an edge of the device electrode 3.

Step-d

The activating step was carried out in the same manner as in Example 4.

The surface conduction electron-emitting device of this Example 7 was manufactured ten times through the steps described above, and current versus voltage characteristics of each of the manufactured devices were measured under the same conditions as in Example 4. Stable characteristics similar to those in Example 4 were obtained. Values and variations of If, Ie resulted by applying pulses of 14 V are below.

| | If (mA) | | Ie (μA) | |
|---|---|---|---|---|
| | Average value | Variations (%) | Average value | Variations (%) |
| Example 7 | 1.8 | 7.0 | 0.9 | 6.0 |

[Example 8]

In this Example 8, four devices were manufactured as in Step-a and Step-b of Comparative Example 1, a cleaned quartz glass was used as the substrate, and two device electrodes of Pt and an electro-conductive thin film made up of PdO fine particles were formed on the substrate.

Step-c

The thus-obtained device was set in the vacuum treatment apparatus, and the vacuum vessel 16 was evacuated to establish a pressure of $1\times10^{-4}$ Pa or less. The evacuating apparatus used in this Example includes a ultra-high vacuum evacuation system comprising a sorption pump and an ion pump. Subsequently, triangular wave pulses having crest values gradually increased as shown in FIG. 5B were applied to the device. The pulse width was set to 1 msec and the pulse interval was set to 10 msec. During an off-period between the triangular wave pulses, a rectangular wave pulse of 0.1 V was inserted to measure a resistance value of the device.

As the crest value of the triangular wave pulse was gradually increased, a peak value of the device current If was also gradually increased in proportional relation during an initial stage. The measured resistance value was also initially constant.

The resistance value was then reduced and the If value started deviating from proportional relation correspondingly. At the time the resistance value was reduced down 10%, application of the pulses was stopped.

Such a reduction in the resistance value is presumably caused by, in some part, a lowering in resistivity of PdO due to a temperature rise and, in great part, partial reduction of PdO into Pd. PdO is easily reduced by heating in an atmosphere deprived of oxygen. It is thought that the above phenomenon was developed by the PdO film being heated upon application of the pulses and reduction of PdO into Pd being started near the middle between the device electrodes. If the pulse crest value was further continued to increase, the conventional energization forming was caused, but in this Example, application of the pulses was stopped in condition where a very narrow reduced area was formed centrally of the electro-conductive thin film, the reduced area serving as a structural latent image.

Step-d

The thus-obtained device was taken out of the vacuum vessel and immersed in dilute nitric acid, followed by washing and drying. The reduced Pd was dissolved by reacting with the dilute nitric acid, but PdO remained without causing any reaction. The structural latent image was thus developed to form the electron-emitting region. The device electrodes of Pt were not appreciably damaged. Then, the device was returned into the vacuum vessel and the same pulses as above were applied to the device again. This treatment was intended to cut off the portions which had not been cut off thoroughly in the preceding treatment, thereby completely forming the electron-emitting region.

When the pulse crest value reached about 1.0 V, the resistance value exceeded 1 MΩ and, at this point in time, application of the pulses was stopped.

Step-e

After lowering the pressure in the vacuum vessel to $1.3\times10^{-4}$ Pa, acetone was introduced to the vacuum vessel and the pressure was adjusted to $1.3'10^{-1}$ Pa. The activating step was carried out by applying rectangular pulses with the crest value set to 15 V, the pulse width set to 1 msec and the pulse interval set to 10 msec. After 30 minutes, the activating step was finished by stopping application of the pulses, followed by further evacuating the vacuum vessel.

Step-f

The stabilizing step was carried out by heating the vacuum vessel to about 200° C. and the device to 250° C. while continuing to evacuate the vacuum vessel for 5 hours.

Then, after heating was stopped and the device was returned to the room temperature, characteristics of electron emission from each device were measured under the same conditions as in Example 1 and Comparative Example 1. Results of the measurement are below.

| | If (mA) | | Ie ($\mu$A) | |
|---|---|---|---|---|
| | Average value | Variations (%) | Average value | Variations (%) |
| Example 9 | 0.85 | 6.5 | 0.80 | 6.0 |

After that, the shape of the electron-emitting region of each device was observed by using an SEM. The electron-emitting region extended while zigzagging to some extent, but the zigzag pattern was very moderate with a width of about 5 $\mu$m. Such remarkable changes in width of the electron-emitting region depending on locations as found in Comparative Example 1 were not found.

[Example 9]

Figure 21A:
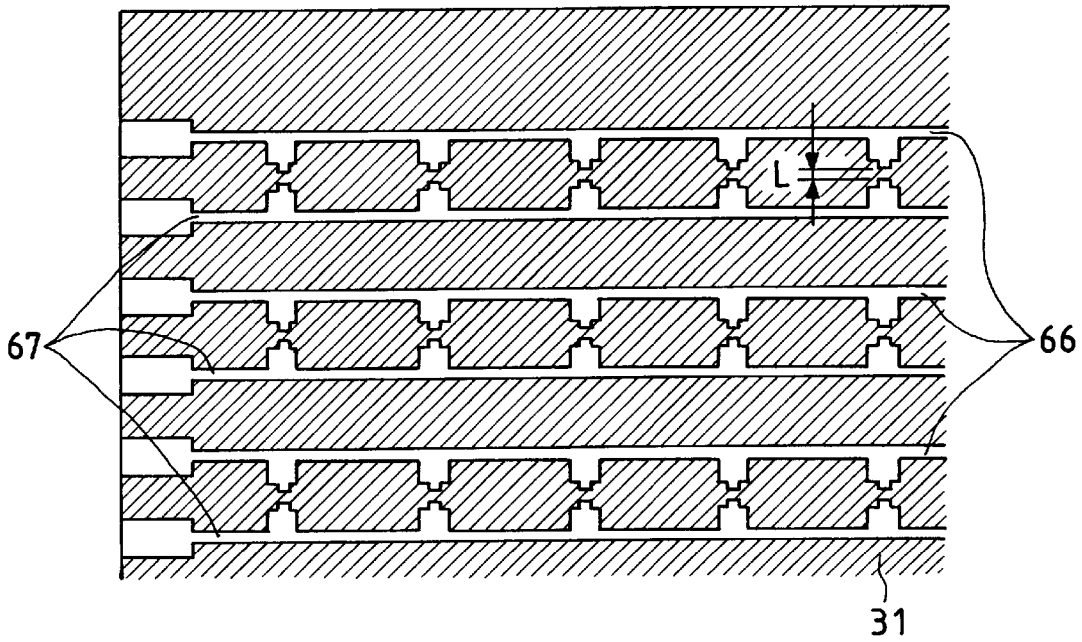
FIGS. 21A to 21C are schematic views for explaining a manufacture process for the electron source of ladder wiring type manufactured by the present invention.
Figure 21B:
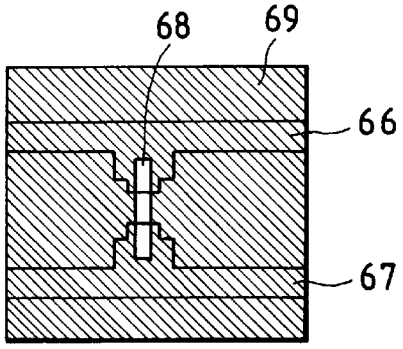
Figure 21C:
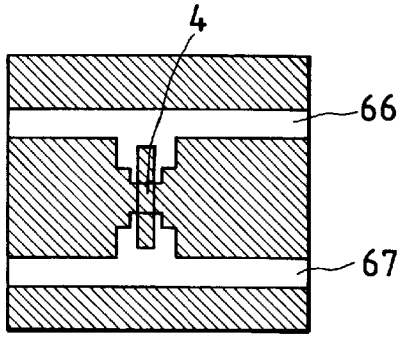

This Example concerns manufacture of an electron source of ladder wiring type and also manufacture of an image-forming apparatus using the electron source. FIGS. 21A to 21C schematically show part of the following steps. The manufacture process of this is constructed by arraying a number 100 of electron-emitting devices in one row and interconnecting the devices in ladder wiring, and then arraying the row in number 100 as a whole.

Step-A

The electron source substrate 31 was prepared by forming a silicon oxide film 0.5 $\mu$m thick was on a cleaned soda lime glass by sputtering. A photoresist (RD-2000N-41, by Hitachi Chemical Co., Ltd.) was formed and patterned on the substrate to have openings each corresponding to the shape of a positive pole, one of the common wires doubling as device electrodes. A Cr film being 5 nm thick and an Au film being 50 nm thick were then deposited thereon in this order by vacuum vapor deposition. The photoresist pattern was dissolved by an organic solvent to leave the deposited Cr/Au films by lift-off, thereby forming common wires 66 doubling as the device electrodes on the positive pole side. Likewise, a photoresist was formed and patterned again on the substrate to have openings each corresponding to the shape of the negative pole, one of the common wires. A Ti film being 5 nm thick and a Pt film being 50 nm thick were then deposited thereon in this order to form common wires 67 doubling as the device electrodes on the negative pole side by lift-off. The spacing between the device electrodes was set to L=50 $\mu$m (See FIG. 21A).

Step-B

A Cr film being 300 nm thick was deposited by vacuum evaporation on the substrate, and openings 68 each corresponding to the shape of each electro-conductive thin film were defined by ordinary photolithography, thereby forming a Cr mask 69 (See FIG. 21B).

Then, a Pd amine complex solution (ccp4230, by Okuno Pharmaceutical Co., Ltd.) was coated on the substrate under rotation by using a spinner, followed by heating for calcination in open air at 300° C. for 12 minutes. The thus-formed film was an electro-conductive fine particle film containing PdO as a primary component and having a thickness of about 7 nm.

Step-C

The Cr mask was removed by wet etching. The PdO fine particle film was patterned by lift-off to form the electro-conductive thin films 4 in a desired pattern. Each of the electro-conductive thin films 4 had a resistance value Rs=$2\times10^4$ $\Omega/\square$ (See FIG. 21C).

One example of the process of manufacturing an image-forming apparatus using the electron source thus fabricated will be described with reference to FIGS. 12 and 13.

After fixing the electron source substrate 31 onto the rear plate 41, the grid electrodes 62 were assembled in place and the externally extending terminals 64 and the externally extending grid electrode terminals 65 were connected to the envelope. Then, the face plate 46 (comprising the fluorescent film 44 and the metal back 45 laminated on the inner surface of the glass base plate 43) was disposed 5 mm above the substrate 31 with the intervention of the support frame 42 between. After applying frit glass to joined portions between the face plate 46, the support frame 42 and the rear plate 41, the assembly was baked in an atmosphere of air at 400° C. for 10 minutes or more for hermetically sealing the joined portions. Frit glass was also used to fix the substrate 31 to the rear plate 41.

The fluorescent film 44 is formed of only a fluorescent substance in the monochrome case. For producing a color image, this Example employed a stripe pattern of fluorescent substances. Thus, the fluorescent film 44 was fabricated by first forming black stripes and then coating fluorescent substances in respective colors in gaps between the black stripes. The black stripes were formed by using a material containing graphite as a primary component which is conventionally employed in the art. Fluorescent substances were coated on the glass substrate 43 by the slurry method.

On the inner surface of the fluorescent film 44, the metal back 45 is usually disposed. After forming the fluorescent film, the metal back 45 was fabricated by smoothing the inner surface of the fluorescent film (this step being usually called filming) and then depositing Al thereon by vacuum vapor deposition.

To increase electrical conductivity of the fluorescent film 44, the face plate 46 may be provided with a transparent electrode (not shown) on an outer surface of the fluorescent film 44 in some cases. Such a transparent electrode was omitted in this Example because sufficient electrical conductivity was obtained with the metal back alone.

Before the above hermetic sealing, alignment of the respective parts was carried out with due care since the fluorescent substances in respective colors and the electron-emitting devices must be precisely aligned with each other in the color case.

Figure 22:
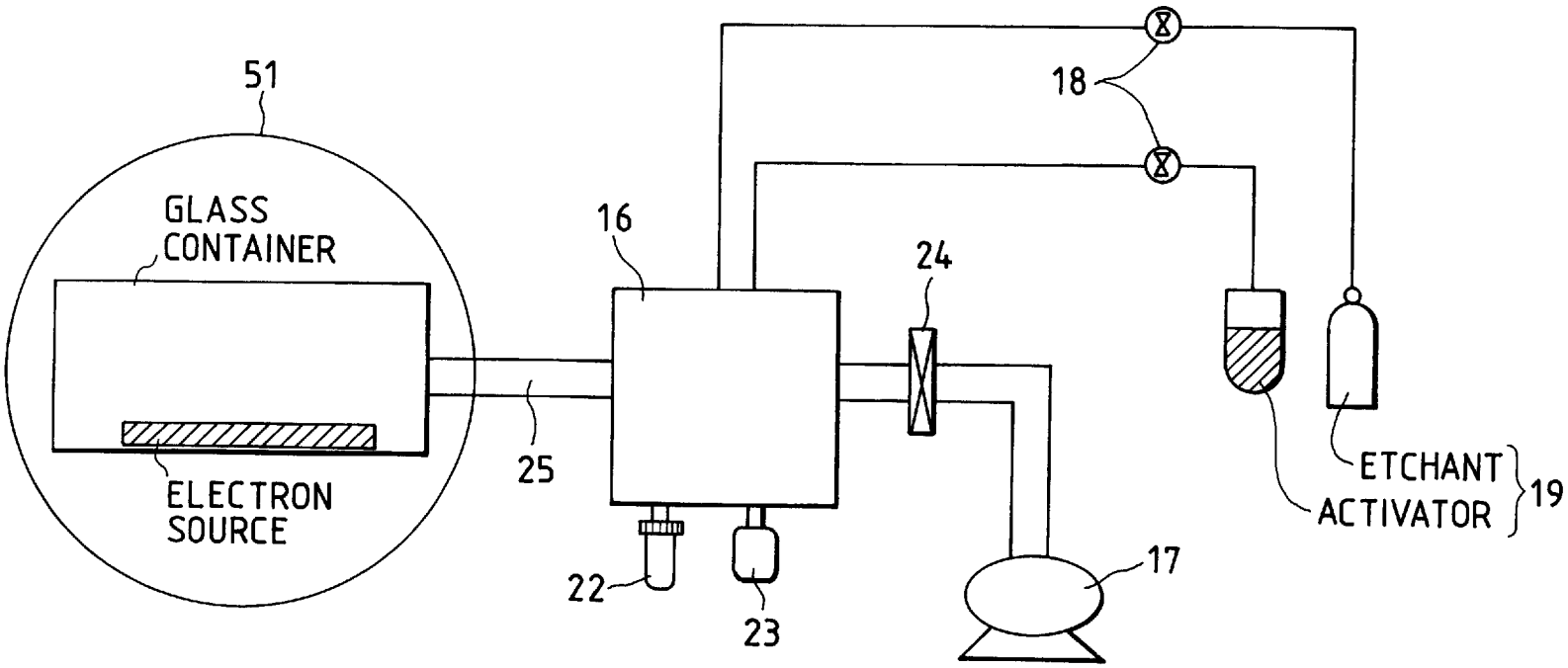
FIG. 22 is a diagram showing the configuration of a vacuum treatment apparatus for use in manufacturing an image-forming apparatus by the present invention.

The image-forming apparatus thus manufactured was connected to a vacuum treatment apparatus shown in FIG. 22. Thus, the image-forming apparatus 51 was connected through an evacuation tube 25 to a vacuum chamber 16 which is in turn connected to an evacuating apparatus 17. In this Example, the evacuating apparatus 17 included a ultra-high vacuum evacuation system comprising a sorption pump and an ion pump. Evacuating capacity was adjustable by a gate valve 24. Connected to the vacuum chamber 16 were gas introducing/controlling means 18 in two systems one of which was used to introduce an activating material and the other of which was used to introduce etching gas. This Example employed acetone as the activating gas and hydrogen as the reducing gas.

Further, the vacuum chamber 16 was provided with a quadruple mass spectrometer (Q-mass) 23 and a pressure gauge 23 for detecting the pressure and atmosphere in the vacuum chamber. The following steps were carried out by regarding the atmosphere detected by the Q-mass as the atmosphere in the vacuum container or envelope of the image-forming apparatus 51.

After evacuating the interior of the image-forming apparatus 51 to establish a pressure of $1\times10^{-5}$ Pa or less, hydrogen gas was introduced and the pressure was adjusted to $1.3\times10^{-2}$ Pa.

The image-forming apparatus 51 was heated to about 300° C. by using a hot plate (not shown). A resistance value of each device row was measured while maintaining the above temperature. After 30 minutes, the resistance values of all the device rows exceeded 10 kΩ, and hence the heating and the introduction of hydrogen were stopped at this point in time. After returning the image-forming apparatus 51 to the room temperature and lowering the pressure in the vacuum chamber 16 to $1\times10^{-5}$ Pa or less, acetone was introduced and the pressure was adjusted to $1.3\times10^{-1}$ Pa.

In that condition, a pulse voltage was applied to between positive and negative pole sides of each device row.

The applied pulses were rectangular wave pulses having a crest value of 15 V, a pulse width of 100 lsec, and a pulse interval of 10 msec. After carrying out this treatment for 30 minutes, the introduction of acetone was stopped. The vacuum container was then continuously evacuated again for 5 hours while heating it to 250° C. by using the hot plate. After that, the device current If and the emission current Ie were measured while applying rectangular wave pulses of 14 V to the devices and 1 kV to between the metal back and the devices, for confirming stable characteristics of electron emission. Subsequently, the evacuation tube was heated and melted to be hermetically sealed off. Then, the getter (not shown) was flash ed by high-frequency heating to keep the pressure in the vacuum container at a sufficiently low level.

[Comparative Example 5]

An electron source was manufactured by carrying out the above Step-a to Step-c like Example 9. Then, the face plate, the back plate, the support frame, the grid electrodes, etc. were assembled and hermetically sealed off to complete the outer configuration of an image-forming apparatus. The image-forming apparatus was connected to a similar vacuum treatment apparatus as used above, and the pressure in the vacuum container was lowered to $1\times10^{-5}$ Pa or less.

Subsequently, the forming treatment was carried out for each of device row by applying triangular wave pulses having crest values gradually increased as shown in FIG. 5B. The pulse width was set to 1 msec and the pulse interval was set to 10 msec. During an off-period between the triangular wave pulses, a rectangular wave pulse of 0.1 V for measurement of resistance was inserted to carry out the treatment while measuring If to detect a resistance value of the device row. At the time the resistance values exceeded 10 kΩ, the forming treatment was stopped. All the device rows were subjected to the forming treatment in this way.

Then, the image-forming apparatus was completed by carrying out the activating step and the stabilizing step, sealing off the evacuation tube, and flashing the getter in the same manner as in Example 9.

Characteristics of electron emission of the image-forming apparatus of Example 9 and Comparative Example 5 were measured for each of the device rows under condition that the potential difference between the devices and the metal back was 1 kV. The voltage applied to the devices was provided in the form of rectangular wave pulses having a crest value of 14 V, a rectangular wave pulses having a crest value of 14 V, a pulse width of 100 μsec, and a pulse interval of 10 msec. Average values and variations of If and Ie measured for each of the device rows (including 100 devices) are below.

| | If (mA) | | Ie (μA) | |
|---|---|---|---|---|
| | Average value | Variations (%) | Average value | Variations (%) |
| Example 9 | 200 | 3.5 | 100 | 2.0 |
| Com. Ex. 9 | 200 | 15 | 100 | 9 |

[Example 10]

This Example concerns an electron source comprising a number of surface conduction electron-emitting devices arrayed interconnected in simple matrix wiring. Incidentally, the array size was 60×60.

Figure 23:
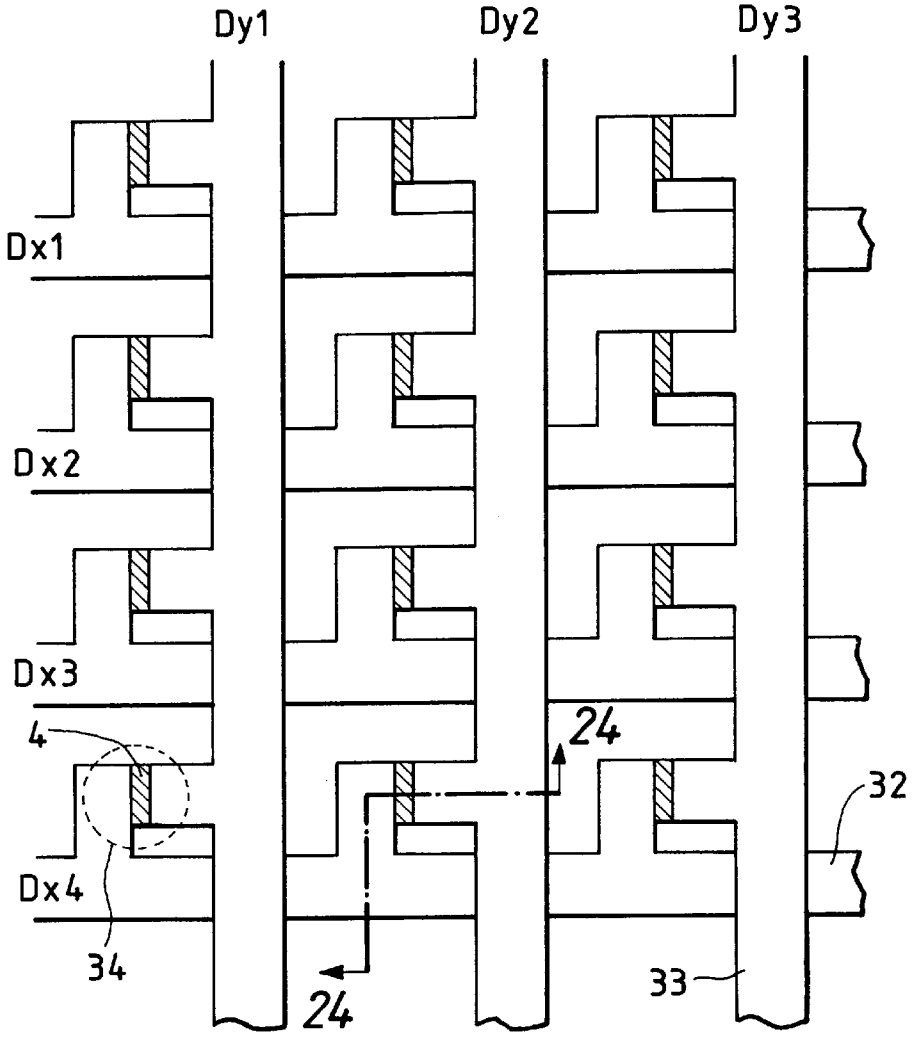
FIG. 23 is a schematic plan view showing part of the configuration of an electron source of matrix wiring type.
Figure 24:
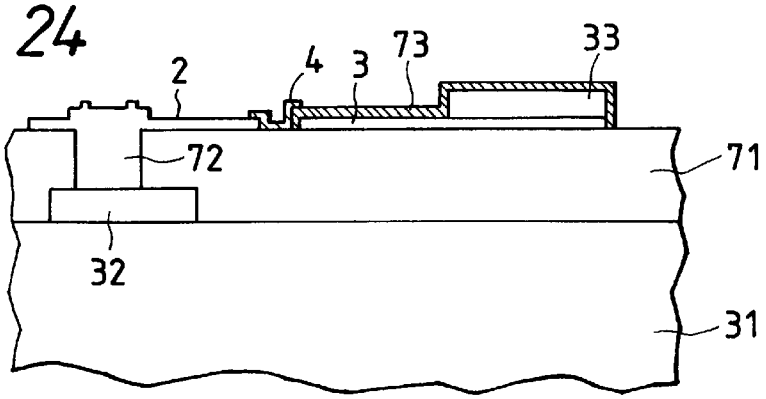
FIG. 24 is a sectional view taken along line 24—24 shown in FIG. 23.
Figure 25A:
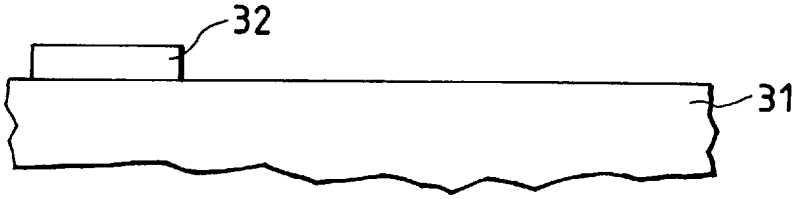
FIGS. 25A to 25H are schematic views for explaining a manufacture process for the electron source of matrix wiring type.
Figure 25B:
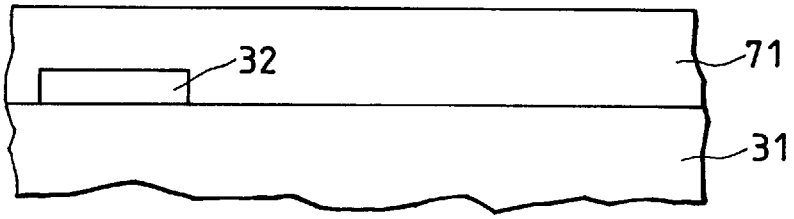
Figure 25C:
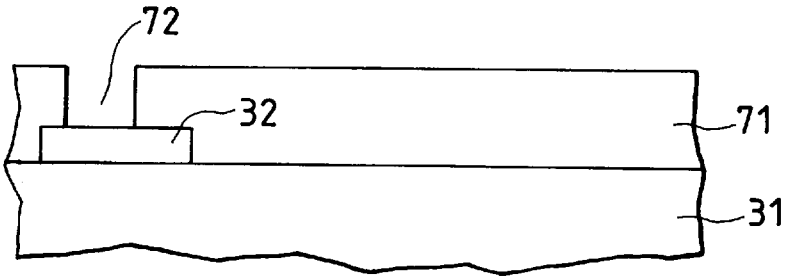
Figure 25D:
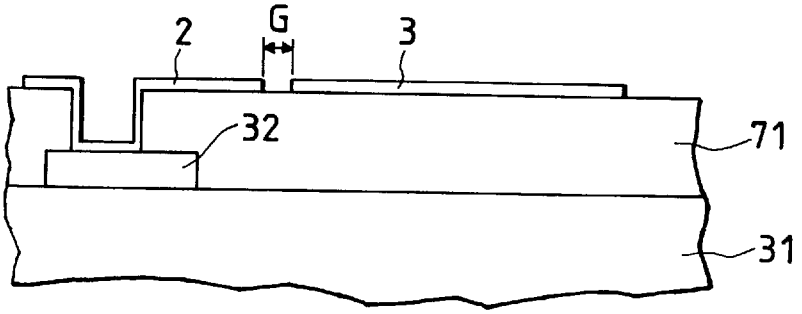
Figure 25E:
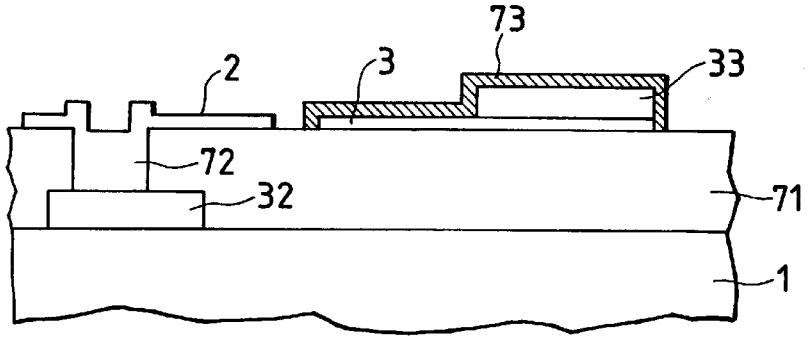
Figure 25F:
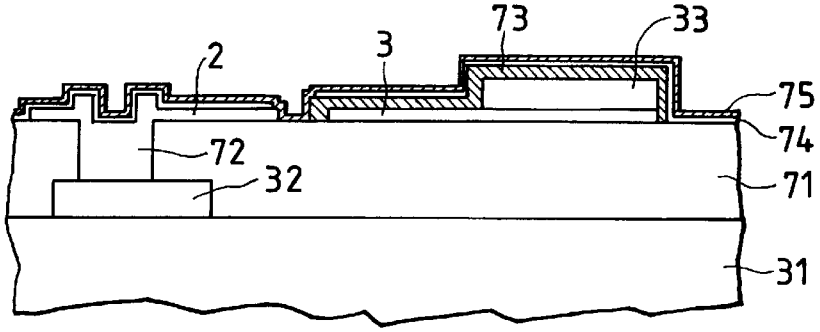
Figure 25G:
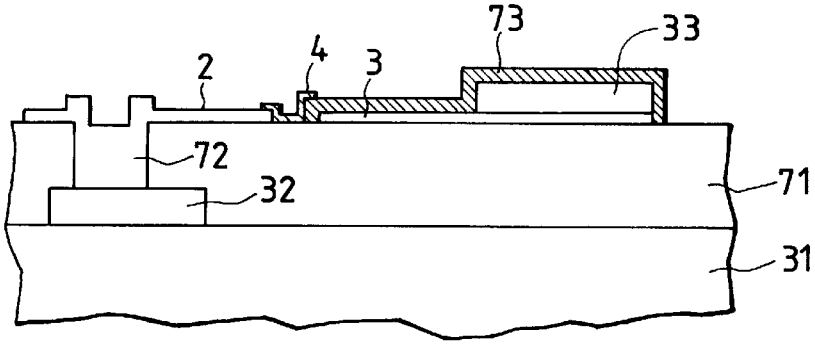
Figure 25H:
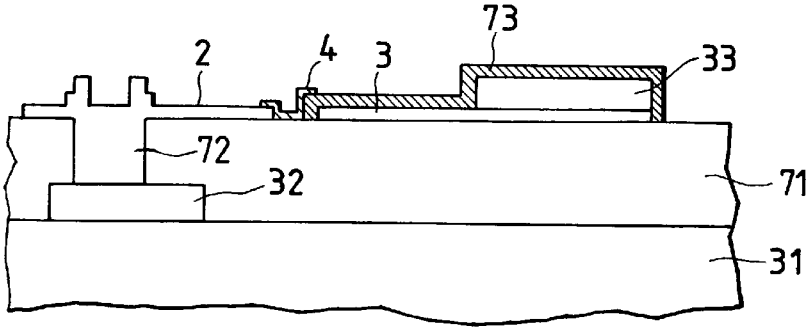

FIG. 23 shows part of the electron source in a plan view, FIG. 24 shows a section taken along line 24—24 in FIG. 23, and FIGS. 25A to 25H show successive steps of the manufacture process.

In these figures, 31 is a substrate, 32 is a Y-directional wire (called also an upper wire), 2, 3 are device electrodes, 4 is a thin film including an electron-emitting region, 71 is an interlayer insulating layer, 72 is a contact hole for electrically connecting the device electrode 2 and the lower wire 32.

The manufacturing process will be described below in detail following the successive steps with reference to FIGS. 25A to 25H. The following steps A to H correspond, respectively, to FIGS. 25A to 25H.

(Step A)

The substrate 31 was prepared by forming a silicon oxide film being 0.5 μm thick on a cleaned soda lime glass by sputtering. A Cr film being 5 nm thick and an Au film being 600 nm thick were then laminated on the substrate 31 in this order by vacuum vapor deposition. A photoresist (AZ1370, by Hoechst Co.) was coated thereon under rotation by using a spinner and then baked. Thereafter, by exposing and developing a photomask image, a resist pattern for the lower wires 32 was formed. The deposited Au/Cr films were selectively removed by wet etching to thereby form the lower wires 32 in a desired pattern.

(Step B)

Then, an interlayer insulating layer 71 formed of a silicon oxide film being 1.0 μm thick was deposited over the entire substrate by RF sputtering.

(Step C)

A photoresist pattern for forming the contact holes 72 in the silicon oxide film deposited in Step B was coated and, by using it as a mask, the interlayer insulating layer 71 was selectively etched to form the contact holes 72. The etching was carried out by RIE (Reactive Ion Etching) using a gas mixture of $CF_4$ and $H_2$.

(Step D)

A photoresist (RD-2000N-41, by Hitachi Chemical Co., Ltd.) was formed in a pattern to define the device electrodes 2, 3 and gaps G therebetween. A Ti film being 5 nm thick and a Pt film being 50 nm thick were then deposited thereon in this order by vacuum vapor deposition. The photoresist pattern was dissolved by an organic solvent to leave the deposited Pt/Ti films by lift-off, thereby forming the device electrodes 2, 3.

(Step E)

A photoresist pattern for the upper wires 33 was formed on the device electrodes 2 and 3. A Ti film being 5 nm thick and an Au film being 500 nm thick were then deposited thereon in this order by vacuum vapor deposition. The unnecessary photoresist pattern was removed to form the upper wires 33 in a desired pattern by lift-off. Then, an Au coating layer 73 being 50 nm thick was formed on the device electrode 3 by electrolytic plating. Incidentally, the spacing between the device electrodes was set to L=30 $\mu$m.

(Step F)

Next, a Cr film 74 being 100 nm thick was deposited by vacuum evaporation and patterned by photolithography to have openings corresponding to the pattern of the electro-conductive thin films 4. A Pd amine complex solution (ccp4230) was coated thereon under rotation by using a spinner and then heated for calcination at 300° C. for 10 minutes. An electro-conductive thin film 75 made up of PdO fine particles was thereby formed and had a film thickness of 10 nm.

(Step G)

The Cr film 74 was etched away by wet etching using an etchant along with unnecessary portions of the electro-conductive thin film 75 made up of PdO fine particles. The electro-conductive thin films 4 in a desired pattern were thereby formed and had a resistance value Rs of about $5\times10^4$ Ω/□.

(Step H)

A resist was coated in a pattern to cover the surface other than the contact holes 72. A Ti film being 5 nm thick and an Au film being 500 nm thick were then deposited thereon in this order by vacuum vapor deposition. Unnecessary portions of the deposited Au/Ti films were removed to make the contact holes 72 filled with the deposited films by lift-off.

(Step I)

The thus-obtained electron source was set in a heat treatment furnace in which heat treatment was carried out at 300° C. for 20 minutes in stream of a gas mixture of 98% $N_2$—2% $H_2$. With this heat treatment, the electron-emitting region 5 was formed in each of the electro-conductive thin films 4 along an edge of the device electrode 3 covered by the Au coating 73.

One example of the process of manufacturing an image-forming apparatus by using the electron source thus fabricated will be described with reference to FIG. 9.

The electron source substrate 31 was fixed onto the rear plate 41. Then, the face plate 36 (comprising the fluorescent film 44 and the metal back 45 laminated on the inner surface of the glass substrate 43) was disposed 5 mm above the substrate 31 with the intervention of the support frame 32 between. After applying frit glass to joined portions between the face plate 46, the support frame 42 and the rear plate 41, the assembly was baked in an atmosphere of open air at 410° C. For 10 minutes to hermetically seal the joined portions. Frit glass was also used to fix the substrate 31 to the rear plate 41. In FIG. 9, 34 is an electron-emitting device and 32 and 33 are X- and Y-directional wires, respectively.

The constructions of the fluorescent film, the metal back and so on were the same as in Example 9. Alignment between the face plate and the electron source was carried out with due care as required in Example 9.

After evacuating the glass panel of the image-forming apparatus by a vacuum pump through an evacuation tube, the activating step was carried out by applying voltage pulses to each of the devices through the externally extending terminals Dox1 to Doxm and Doy1 to Doyn.

The pulses were applied for each of the X-directional device rows while the Y-directional wires were connected in common. The applied pulses were rectangular wave pulses having a crest value of 14 V, a pulse width of 1 msec, and a pulse interval of 10 msec. The pressure in the glass panel was $1.3\times10^{-3}$ Pa.

After that, the glass panel was continuously evacuated to establish a pressure of $4.2\times10^{-5}$ Pa or less. The electron-emitting devices were then driven in a simple matrix manner for confirming that the electron source operated normally to display images and characteristics were stable. After the confirmation, the evacuation tube (not shown) was heated by a gas burner and melted to hermetically seal off the vacuum envelope.

Finally, the getter placed in the envelope was flashed by high-frequency heating to maintain a desired degree of vacuum after the sealing-off.

In the thus-completed image-forming apparatus of the present invention, electrons were emitted by applying the scan signal and the modulation signal to the electron-emitting devices from the respective signal generating means (not shown) through the externally extending terminals Dox1 to Doxm and Doy1 to Doyn. The electron beams were accelerated by applying a high voltage of 5.0 kV to the metal back 45 or the transparent electrode (not shown) through the high-voltage terminal Hv, causing the accelerated electrons to impinge against the fluorescent film 44 which were excited to generate fluorescence to form an image.

While the electron sources were manufactured in Examples 9 and 10 by using a plurality of electron-emitting devices each identical to the surface conduction electron-emitting device of Example 1, the electron sources and the image-forming apparatus according to the present invention are not limited to those Examples. It is possible to construct an electron source by using any of electron-emitting devices identical to those of Examples 2 to 8, and to construct an image-forming apparatus by using the electron source corresponding to any of Examples 9 and 10.

Figure 26:
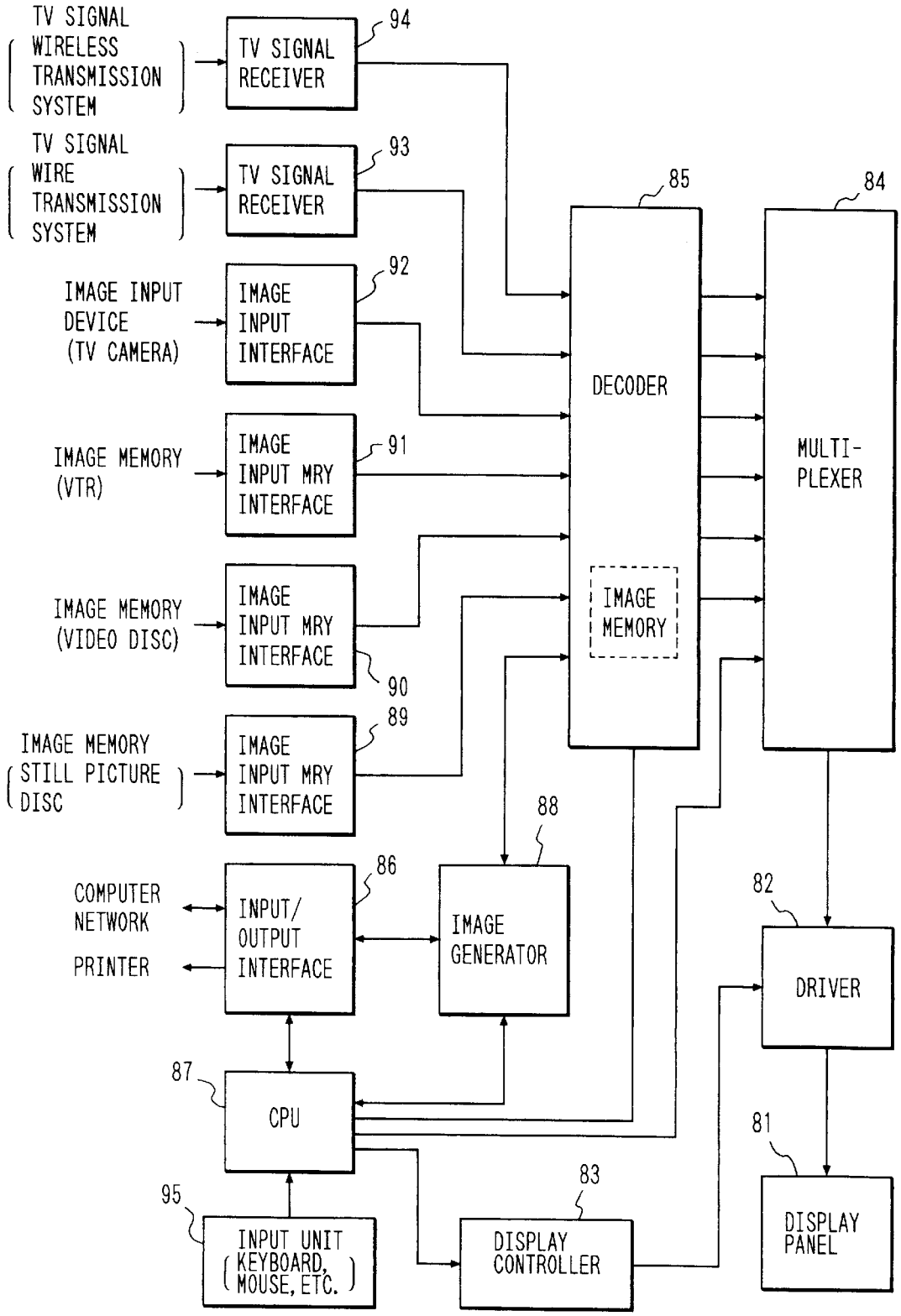
FIG. 26 is a block diagram showing one example of the configuration of an image-forming apparatus.
Figure 27:
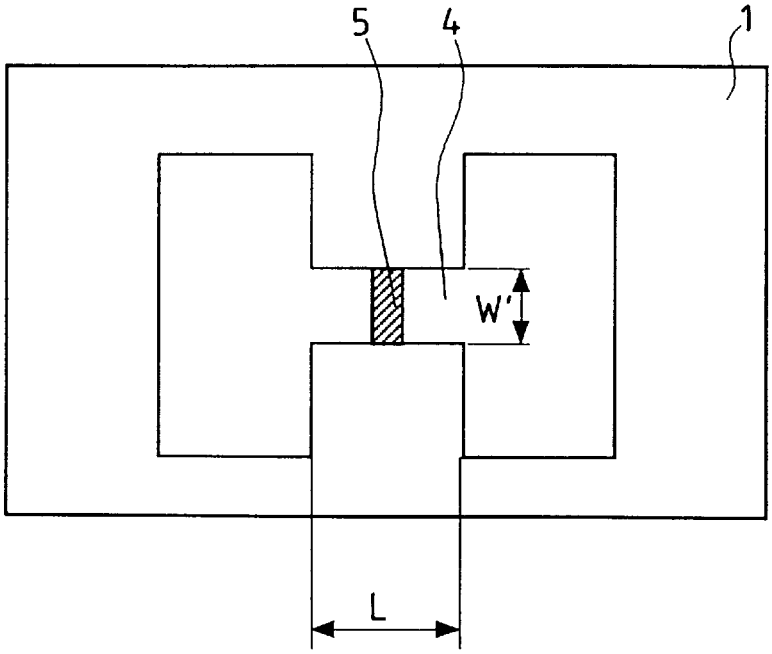
FIG. 27 is a schematic view for explaining the structure of a prior art surface conduction electron-emitting device.

FIG. 26 is a block diagram showing one example of a display device in which the image-forming apparatus (display panel) of Example 10 is arranged to be able to display image information provided from various image information sources including TV broadcasting, for example. In FIG. 26, 81 is a display panel, 82 is a driver for the display panel, 83 is a display controller, 84 is a multiplexer, 85 is a decoder, 86 is an input/output interface, 87 is a CPU, 88 is an image generator, 89, 90 and 91 are image memory interfaces, 92 is an image input interface, 93 and 94 are TV signal receivers, and 95 is an input unit. (When the display device of this Example receives a signal, e.g., a TV signal, including both video information and voice information, the device of course displays an image and reproduces voices simultaneously. But circuits, a speaker and so on necessary for reception, separation, reproduction, processing, storage, etc. of voice information, which are not directly related to the features of the present invention, will not be described here.)

Functions of the above parts will be described below along a flow of image signals.

First, the TV signal receiver 94 is a circuit for receiving a TV image signal transmitted through a wireless transmission system in the form of electric waves or spatial optical communication, for example. A type of the TV signal to be received is not limited to any particular one, but may be any type of the NTSC-, PAL-and SECAM-standards, for example. Another type TV signal (e.g., so-called high-quality TV signal including the MUSE-standards type) having the larger number of scan lines than the above types is a signal source fit to utilize the advantage of the display panel which is suitable for an increase in the screen size and the number of pixels. The TV signal received by the TV signal receiver 94 is output to the decoder 85.

Then, the TV signal receiver 93 is a circuit for receiving a TV image signal transmitted through a wire transmission system in the form of coaxial cables or optical fibers. As with the TV signal receiver 94, a type of the TV signal to be received by the TV signal receiver 93 is not limited to any particular one. The TV signal received by the receiver 93 is also output to the decoder 85.

The image input interface 92 is a circuit for taking in an image signal supplied from an image input unit such as a TV camera or an image reading scanner, for example. The image signal taken in by the interface 92 is output to the decoder 85.

The image memory interface 91 is a circuit for taking in an image signal stored in a video tape recorder (hereinafter abbreviated to a VTR). The image signal taken in by the interface 91 is output to the decoder 85.

The image memory interface 90 is a circuit for taking in an image signal stored in a video disk. The image signal taken in by the interface 90 is output to the decoder 85.

The image memory interface 89 is a circuit for taking in an image signal from a device storing still picture data, such as a so-called still picture disk. The image signal taken in by the interface 89 is output to the decoder 85.

The input/output interface 86 is a circuit for connecting the display device to an external computer or computer network, or an output device such as a printer. It is possible to perform not only input/output of image data and character/figure information, but also input/output of a control signal and numeral data between the CPU 87 in the display device and the outside in some cases.

The image generator 88 is a circuit for generating display image data based on image data and character/figure information input from the outside via the input/output interface 86, or image data and character/figure information output from the CPU 87. Incorporated in the image generator 88 are, for example, a rewritable memory for storing image data and character/figure information, a read only memory for storing image patterns corresponding to character codes, a processor for image processing, and other circuits required for image generation.

The display image data generated by the image generator 88 is usually output to the decoder 85, but may also be output to an external computer network or a printer via the input/output interface 86 in some cases.

The CPU 87 carries out primarily operation control of the display device and tasks relating to generation, selection and editing of a display image.

For example, the CPU 87 outputs a control signal to the multiplexer 84 for selecting one of or combining ones of image signals to be displayed on the display panel as desired. In this connection, the CPU 87 also outputs a control signal to the display panel controller 83 depending on the image signal to be displayed, thereby properly controlling the operation of the display device in terms of picture display frequency, scan mode (e.g., interlace or non-interlace), the number of scan lines per picture, etc.

Furthermore, the CPU 87 outputs image data and character/figure information directly to the image generator 88, or accesses to an external computer or memory via the input/output interface 86 for inputting image data and character/figure information. It is a matter of course that the CPU 87 may be used in relation to any suitable tasks for other purposes than the above. For example, the CPU 87 may directly be related to functions of producing or processing information as with a personal computer or a word processor. Alternatively, the CPU 87 may be connected to an external computer network via the input/output interface 86, as mentioned above, to execute numerical computations and other tasks in cooperation with external equipment.

The input unit 95 is employed when a user enters commands, programs, data, etc. to the CPU 87, and may be any of various input equipment such as a keyboard, mouse, joy stick, bar code reader, and voice recognition device.

The decoder 85 is a circuit for reverse-converting various image signals input from the circuits 88 to 94 into signals for three primary colors, or a luminance signal, an I signal and a Q signal. As indicated by dot lines in the drawing, the decoder 85 preferably includes an image memory therein. This is because the decoder 85 also handles those TV signals including the MUSE-standards type, for example, which require an image memory for the reverse-conversion. Further, the provision of the image memory brings about an advantage of making it possible to easily display a still picture, or to easily perform image processing and editing, such as thinning-out, interpolation, enlargement, reduction and synthesis of images, in cooperation with the image generator 88 and the CPU 87.

The multiplexer 84 selects a display image in accordance with the control signal input from the CPU 87 as desired. In other words, the multiplexer 84 selects a desired one of the reverse-converted image signals input from the decoder 85 and outputs it to the driver 82. In this connection, by switching between two or more of the image signals in a display time for one picture, different images can also be displayed in plural respective areas defined by dividing one screen as with the so-called multiscreen television.

The display panel controller 83 is a circuit for controlling the operation of the driver 82 in accordance with a control signal input from the CPU 87.

As a function relating to the basic operation of the display panel, the controller 83 outputs to the driver 82 a signal for controlling, by way of example, the operation sequence of a power supply (not shown) for driving the display panel. Also, as a function relating to a method of driving the display panel, the controller 83 outputs to the driver 82 signals for controlling, by way of example, a picture display frequency and a scan mode (e.g., interlace or non-interlace).

Depending on cases, the display panel controller 83 may output to the driver 82 control signals for adjustment of image quality in terms of luminance, contrast, tone and sharpness of the display image.

The driver 82 is a circuit for producing a drive signal applied to the display panel 81. The driver 82 is operated in accordance with the image signal input from the multiplexer 84 and the control signal input from the display panel controller 83.

With the various components arranged as shown in FIG. 26 and having the functions as described above, the display device can display image information input from a variety of image information sources on the display panel 81. More specifically, various image signals including the TV broadcasting signal are reverse-converted by the decoder 85, and at least one of them is selected by the multiplexer 84 upon demand and then input to the driver 82. On the other hand, the display controller 83 issues a control signal for controlling the operation of the driver 82 in accordance with the image signal to be displayed. The driver 82 applies a drive signal to the display panel 81 in accordance with both the image signal and the control signal. An image is thereby displayed on the display panel 81. A series of operations mentioned above are controlled under supervision of the CPU 87.

In addition to simply displaying the image information selected from plural items with the aid of the image memory built in the decoder 85, the image generator 88 and the CPU 87, the display device of this Example can also perform, on the image information to be displayed, not only image processing such as enlargement, reduction, rotation, movement, edge emphasis, thinning-out, interpolation, color conversion, and conversion of image aspect ratio, but also image editing such as synthesis, erasure, coupling, replacement, and inset. Although not especially specified in the description of this Example, there may also be provided a circuit dedicated for processing and editing of voice information, as well as the above-explained circuits for image processing and editing.

Accordingly, even a single unit of the display device of this Example can have functions of a display for TV broadcasting, a terminal for TV conferences, an image editor handling still and motion pictures, a computer terminal, an office automation terminal including a word processor, a game machine and so on; hence it can be applied to very wide industrial and domestic fields.

It is needless to say that FIG. 26 only shows one example of the configuration of the display device using the display panel in which the electron source comprises surface conduction electron-emitting elements, and the present invention is not limited to the illustrated example. For example, those circuits of the components shown in FIG. 26 which are not necessary for the purpose of use may be dispensed with. On the contrary, depending on the purpose of use, other components may be added. When the display device of this Example is employed as a TV telephone, it is preferable to provide, as additional components, a TV camera, an audio microphone, an illuminator, and a transmission/reception circuit including a modem.

[Example 11]

Steps A to C were carried out in the same manner as in Example 10.

Step-D

A photoresist pattern having openings corresponding to the shapes of the device electrodes 2, 3 were formed. A Ti film being 5 nm thick and a Ni film being 30 nm thick were then deposited thereon in this order by vacuum vapor deposition. The photoresist pattern was dissolved by an organic solvent to leave the deposited Ni/Ti films by lift-off, thereby forming the pattern of the device electrodes. Then, a photoresist was coated on the substrate except the portions each corresponding to the device electrode 3. A Ni film being 90 nm thick was further deposited and patterned by lift-off again, thereby forming the device electrodes 3 having a thickness of 120 nm. The spacing between the device electrodes was set to L=80 $\mu$m.

Step-E

A photoresist pattern for the upper wires (the Y-directional wires) was formed. A Ti film being 5 nm thick and an Au film being 500 nm thick were then deposited thereon in this order by vacuum evaporation to form the upper wires in a desired pattern by lift-off of the deposited Au/Ti films.

Step-F

A Cr film being 100 nm thick was formed by vacuum evaporation on the substrate and patterned to provide a mask having openings each corresponding to the shape of each electro-conductive thin film.

Then, a Pd amine complex solution (ccp4230, by Okuno Pharmaceutical Co., Ltd.) was coated on the substrate under rotation by using a spinner, followed by heating for calcination in open air at 300° C. for 12 minutes.

Subsequently, the Cr mask was removed by wet etching to form the electro-conductive thin films 4 by lift-off. Each of the electro-conductive thin films 4 had a thickness of 7 nm and a resistance value Rs=$2.1\times10^4$ Ω/□. At this time, in a portion of each electro-conductive thin film along an edge of the device electrode 2 on the substrate, there was formed a structural latent image in which the film thickness was thinner than the other portion and the form of fine particles were different therefrom.

Step-G

A photoresist was coated all over the substrate and patterned to define openings corresponding to the contact holes. A Ti film being 5 nm thick and an Au film being 500 nm thick were then deposited thereon in this order by vacuum evaporation to make the contact holes filled with the deposited Au/Ti films by lift-off.

As with Example 9, the electron source thus fabricated was assembled with the face plate, the rear plate, the support frame, etc., thereby constructing an image-forming apparatus. Frit glass used for hermetic sealing was baked at 400° C. for a longer time (40 minutes) than usual. With this treatment, the structural latent image in the electro-conductive thin film was developed and the electron-emitting region was formed. After that, the activating step was carried out in the same manner as in Example 10, the evacuation tube was sealed off, and the getter was flashed.

The image-forming apparatus thus manufactured was energized to emit electrons from the electron-emitting devices for producing fluorescence. As a result, an image was displayed with small variations in luminance and high quality.

As described hereinabove, using the manufacture method of the present invention makes it possible to control the position and shape of an electron-emitting region of an electron-emitting device, and to achieve uniform device characteristics. When the present invention is practiced as a manufacturing method for an electron source comprising a plurality of electron-emitting devices and an image-forming apparatus using the electron source, variations in the amount of emitted electrons between the electron-emitting devices can be suppressed, variations in the brightness of pictures can be reduced, and display of images with high quality can be realized.

Further, since the need of to flow a great current to form an electron-emitting region is eliminated, current capacity of wiring can be reduced, the degree of freedom in apparatus design can be increased, and the production cost can be cut down.

What is claimed is:

1. A method of manufacturing an electron-emitting device in which an electro-conductive film having an electron-emitting region having a fissure is provided between electrodes disposed on a substrate, comprising:

a step of forming a structural latent image for forming said fissure in an electro-conductive film, and a step of developing said structural latent image to form said fissure by heating said electroconductive film in the electroconductive film in its entirety.

2.A method of manufacturing an electron-emitting device according to claim 1, wherein said step of forming a structural latent image includes forming said electro-conductive film so that said film has a portion being locally different in film thickness.

3. A method of manufacturing an electron-emitting device according to claim 1, wherein said step of forming a structural latent image includes forming said electro-conductive film so that said film has a portion being locally different in morphology.

4. A method of manufacturing an electron-emitting device according to claim 1, wherein said step of forming a structural latent image includes forming said electro-conductive film so that said film extends straddling a stepped portion formed on said substrate.

5. A method of manufacturing an electron-emitting device according to claim 4, wherein two stepped. portions are formed to have different heights between each upper surface of said electrodes and the surface of said substrate.

6. A method of manufacturing an electron-emitting device according to claim 5, wherein two stepped portions are formed to have different heights by forming a pair of said electrodes so that one of said electrodes is thicker than the other of said electrodes.

7. A method of manufacturing an electron-emitting device according to claim 5, wherein two stepped portions are formed to have different heights by forming a height restricting member between said substrate and one of said electrodes.

8. A method of manufacturing an electron-emitting device according to claim 4, wherein said stepped portion is formed by arranging a step forming member between said electrodes.

9. A method of manufacturing an electron-emitting device according to claim 1, wherein said step of forming a structural latent image includes forming a member, which brings about a chemical reaction with said electro-conductive film in said developing step, in contact with part of said electro-conductive film.

10. A method of manufacturing an electron-emitting device according to claim 9, wherein said member bringing about a chemical reaction with said electro-conductive film makes up at least part of one of said electrodes.

11. A method of manufacturing an electron-emitting device according to claim 1, wherein said electro-conductive film is heated by an external heat source.

12. A method of manufacturing an electron-emitting device according to claim 9 or 10, wherein said step of developing a structural latent image includes heating said electro-conductive film in an atmosphere of reducing gas, of inert gas or under reduced pressure.

13. A method of manufacturing an electron-emitting device according to claim 9 or 10, wherein said step of developing a structural latent image includes a step of applying voltage to said electro-conductive film.

14. A method of manufacturing an electron-emitting device according to claim 1, wherein said step of forming a structural latent image includes changing a portion of said electro-conductive film locally so that the portion becomes removable by chemical reaction in said developing step subsequently conducted.

15. A method of manufacturing an electron-emitting device according to claim 14, wherein said portion is made of a metal formed. in part of the electro-conductive film made of a metal oxide.

16. A method of manufacturing an electron-emitting device according to claim 15, wherein said step of developing said structural latent image includes selectively removing said portion made of metal by etching.

17. A method of manufacturing an electron source comprising a plurality of electron-emitting devices arrayed on a substrate, wherein said electron-emitting devices are each manufactured by the method according to claim 1.

18. A method of manufacturing an electron source according to claim 17, wherein said plurality of electron-emitting devices are interconnected to form a plurality of device rows.

19. A method of manufacturing an electron source according to claim 17, wherein said plurality of electron-emitting devices are arrayed in a matrix wiring pattern.

20. A method of manufacturing an image-forming apparatus in combination of an electron source comprising an array of electron-emitting devices and an image-forming member, wherein said electron-emitting devices are each manufactured by the method according to claim 1.

21. A method of manufacturing an image-forming apparatus according to claim 20, wherein said image-forming member is a fluorescent film.

* * * * *

UNITED STATES PATENT AND TRADEMARK OFFICE

CERTIFICATE OF CORRECTION

PATENT NO. : 5,861,227

DATED : January 19, 1999

INVENTOR(S) : SOTOMITSU IKEDA ET AL.

It is certified that error appears in the above-identified patent and that said Letters Patent is hereby corrected as shown below:

On the title page, item

[54] TITLE

"METHOD AND" should read --METHODS OF--.

[75] INVENTORS

"Yasuhiro Hamamoto, Machida" should read --Yasuhiro Hamamoto, Machida-shi--.

[57] ABSTRACT

Line 15, "less" should read --is fewer--.

COLUMN 1

Line 1, "AND" should read --OF--.

COLUMN 4

Line 4, "method" should read --methods--.
Line 25, "in combination of" should read --combining--.
Line 42, "the-structure" should read --the structure--.

UNITED STATES PATENT AND TRADEMARK OFFICE

CERTIFICATE OF CORRECTION

PATENT NO. : 5,861,227

DATED : January 19, 1999

INVENTOR(S) : SOTOMITSU IKEDA ET AL.

It is certified that error appears in the above-identified patent and that said Letters Patent is hereby corrected as shown below:

COLUMN 7

Line 43, "thin." should read --thin--.
Line 61, "102 to 107" should read --$10^2$ to $10^7$--.

COLUMN 8

Line 26, "rule. Experimental" should read --rule. ¶ Experimental--.
Line 29, "lows. It" should read --lows. ¶ It--.
Line 31, "and" should read --and when--.
Line 39, "22-26) Additionally," should read --22-26) ¶ Additionally;--
Line 43, "follows. In" should read --follows. ¶ In--.

COLUMN 9

Line 27, "the-height" should read --the height--.

COLUMN 11

Line 4, "includes" should read --include--.
Line 22, "those ones," should read --the above--.

UNITED STATES PATENT AND TRADEMARK OFFICE

CERTIFICATE OF CORRECTION

PATENT NO. : 5,861,227

DATED : January 19, 1999

INVENTOR(S) : SOTOMITSU IKEDA ET AL.

It is certified that error appears in the above-identified patent and that said Letters Patent is hereby corrected as shown below:

COLUMN 21

Line 31, "on" should read --under--.

COLUMN 26

Line 64, "0 1 V" should read --0.1 V--.

COLUMN 30

Line 5, "a" should read --an--.
Line 57, "1.3'$10^{-1}$Pa." should read --1.3x$10^{-1}$Pa.--.

COLUMN 31

Line 11, "Example 9" should read --Example 8--.
Line 33, "was" should be deleted.

COLUMN 32

Line 55, "a" should read --an--.

UNITED STATES PATENT AND TRADEMARK OFFICE

CERTIFICATE OF CORRECTION

PATENT NO. : 5,861,227

DATED : January 19, 1999

INVENTOR(S) : SOTOMITSU IKEDA ET AL.

It is certified that error appears in the above-identified patent and that said Letters Patent is hereby corrected as shown below:

COLUMN 33

Line 33, "flash ed" should read --flashed--.
Line 46, "of" should be deleted.
Line 66, "rectangular wave pulses having a" should be deleted.
Line 67, "crest valùe of 14V, a" should be deleted.

COLUMN 34

Line 12, "Com. Ex. 9" should read --Com. Ex. 5--.

COLUMN 40

Line 42, "manufacture" should read --manufacturing--.
Line 54, "of" should be deleted.
Line 55, "current" should read --the current--.

COLUMN 41

Line 1, "in the" should be deleted.
Line 2, "electroconductive film" should be deleted.
Line 19, "stepped." should read --stepped--.

UNITED STATES PATENT AND TRADEMARK OFFICE

CERTIFICATE OF CORRECTION

PATENT NO. : 5,861,227

DATED : January 19, 1999

INVENTOR(S) : SOTOMITSU IKEDA ET AL.

It is certified that error appears in the above-identified patent and that said Letters Patent is hereby corrected as shown below:

COLUMN 42

Line 20, "formed." should read --formed--.
Line 37, "in combination of" should read --combining--.

Signed and Sealed this

Fifteenth Day of August, 2000

*Attest:*

*Attesting Officer*

Q. TODD DICKINSON

*Director of Patents and Trademarks*